US010367266B2

(12) United States Patent
Wong et al.

(10) Patent No.: US 10,367,266 B2
(45) Date of Patent: Jul. 30, 2019

(54) MULTI-ANTENNA COMMUNICATION DEVICE

(71) Applicant: Industrial Technology Research Institute, Hsinchu (TW)

(72) Inventors: Kin-Lu Wong, Hsinchu (TW); Jun-Yu Lu, Hsinchu (TW); De-Ming Chian, Hsinchu (TW); Wei-Yu Li, Hsinchu (TW); Chih-Yu Tsai, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 219 days.

(21) Appl. No.: 15/392,255

(22) Filed: Dec. 28, 2016

(65) Prior Publication Data

US 2018/0183132 A1 Jun. 28, 2018

(30) Foreign Application Priority Data

Dec. 27, 2016 (TW) ..... 105143339 A

(51) Int. Cl.
*H01Q 1/24* (2006.01)
*H01Q 7/00* (2006.01)
(Continued)

(52) U.S. Cl.
CPC ..... *H01Q 7/00* (2013.01); *H01Q 1/243* (2013.01); *H01Q 1/48* (2013.01); *H01Q 21/28* (2013.01)

(58) Field of Classification Search
CPC ..... H01Q 1/24; H01Q 1/48; H01Q 21/28; H01Q 7/00; H01Q 1/243; H01Q 21/06; H01Q 21/061
See application file for complete search history.

(56) References Cited

U.S. PATENT DOCUMENTS 4,460,899 A 7/1984 Schmidt et al.
5,952,983 A 9/1999 Dearnley et al.
(Continued)

FOREIGN PATENT DOCUMENTS

CN 103579758 A 2/2014
TW 200737600 A 10/2007
(Continued)

OTHER PUBLICATIONS

The ARR Antenna Book, Geral Hall, 1988.*
(Continued)

*Primary Examiner* — Jessica Han
*Assistant Examiner* — Awat M Salih
(74) *Attorney, Agent, or Firm* — Mintz Levin Cohn Ferris Glovsky and Popeo, P.C.; Peter F. Corless; Steven M. Jensen

(57) ABSTRACT

A multi-antenna communication device is provided, including a grounding conductor plane separating a first side space and a second side space and having a first edge. A four-antenna array including first, second, third and fourth antennas is located at the first edge, and has an overall maximum array length extending along the first edge. The first and second antennas are located in the first side space, and the third and fourth antennas are located in the second side space. Each of the first to fourth antennas includes a feeding conductor line, a grounding conductor line, and a radiating conductor portion electrically connected to a signal source through the feeding conductor line and electrically connected to the first edge through the grounding conductor line, thereby forming a loop path and generating at least one resonant mode. The radiating conductor portion has a corresponding projection line segment at the first edge.

19 Claims, 14 Drawing Sheets

(51) Int. Cl.
*H01Q 1/48* (2006.01)
*H01Q 21/28* (2006.01)

(56) References Cited

U.S. PATENT DOCUMENTS

| | | | | |
|---|---|---|---|---|
| 5,990,838 | A | 11/1999 | Burns et al. | |
| 6,104,348 | A | 8/2000 | Karlsson et al. | |
| 6,288,679 | B1 | 9/2001 | Fischer et al. | |
| 6,317,009 | B2 | 11/2001 | Hill | |
| 6,344,829 | B1 | 2/2002 | Lee | |
| 6,426,723 | B1 | 7/2002 | Smith et al. | |
| 6,525,694 | B2 | 2/2003 | Jiang et al. | |
| 7,250,910 | B2 | 7/2007 | Yoshikawa et al. | |
| 7,271,777 | B2 | 9/2007 | Yuanzhu | |
| 7,330,156 | B2 | 2/2008 | Arkko et al. | |
| 7,352,328 | B2 | 4/2008 | Moon et al. | |
| 7,385,563 | B2 | 6/2008 | Bishop | |
| 7,405,699 | B2 | 7/2008 | Qin | |
| 7,460,069 | B2 | 12/2008 | Park et al. | |
| 7,498,994 | B2 | 3/2009 | Vacanti | |
| 7,541,988 | B2 | 6/2009 | Sanelli et al. | |
| 7,561,110 | B2 | 7/2009 | Chen | |
| 7,573,433 | B2 | 8/2009 | Qin | |
| 7,586,445 | B2 | 9/2009 | Qin et al. | |
| 7,609,221 | B2 | 10/2009 | Chung et al. | |
| 7,688,273 | B2 | 3/2010 | Montgomery et al. | |
| 7,710,343 | B2 | 5/2010 | Chiu et al. | |
| 7,714,789 | B2 | 5/2010 | Tsai et al. | |
| 7,733,285 | B2 | 6/2010 | Gainey et al. | |
| 9,077,084 | B2 | 7/2015 | Li et al. | |
| 9,166,644 | B2 | 10/2015 | Yoon et al. | |
| 9,236,653 | B2 | 1/2016 | Liu et al. | |
| 2008/0198085 | A1* | 8/2008 | Hsu | H01Q 9/42 343/795 |
| 2009/0322639 | A1 | 12/2009 | Lai | |
| 2010/0134377 | A1 | 6/2010 | Tsai et al. | |
| 2010/0156745 | A1 | 6/2010 | Andrenko et al. | |
| 2010/0156747 | A1 | 6/2010 | Montgomery | |
| 2010/0194642 | A1 | 8/2010 | Rao et al. | |
| 2010/0238079 | A1 | 9/2010 | Ayatollahi et al. | |
| 2010/0295750 | A1 | 11/2010 | See et al. | |
| 2012/0038519 | A1 | 2/2012 | Su | |
| 2013/0314297 | A1* | 11/2013 | Hamabe | H01Q 21/28 343/893 |

FOREIGN PATENT DOCUMENTS

| | | | |
|---|---|---|---|
| TW | 200835057 | A | 8/2008 |
| TW | 1501468 | B | 9/2015 |
| TW | 1530020 | B | 4/2016 |
| WO | 2012/124247 | A1 | 9/2012 |
| WO | 2016138650 | A1 | 9/2016 |

OTHER PUBLICATIONS

Ethier, J., et al., "MIMO Handheld Antenna Design Approach Using Characteristic Mode Concepts," Microwave and Optical Technology Letters, v. 50, Jul. 2008, pp. 1724-1727.

Chen, S., et al., "A Decoupling Technique for Increasing the Port Isolation Between Two Strongly Coupled Antennas," IEEE Transactions on Antennas and Propogation, v. 56, Dec. 2008, pp. 3650-3658.

Coetzee, J., et al., "Compact Multiport Antenna with Isolated Ports," Microwave and Optical Technology Letters, v. 50, Jan. 2008, pp. 229-232.

Ding, Y. et al., "A Novel Dual-Band Printed Diversity Antenna for Mobile Terminals," IEEE Transactions on Antennas and Propogation, v. 55, Jul. 2007, pp. 2088-2096.

Liu, Q. et al., "A Compact Wideband Planar Diversity Antenna for Mobile Handsets," Microwave and Optical Technology Letters, v. 50, Jan. 2008, pp. 87-91.

Chou, J. et al., "Internal Wideband Monopole Antenna for MIMO Access-Point Applications in the WLAN/WiMAX," Microwave and Optical Technology Letters, v. 50, May 2008, pp. 1146-1148.

Chou, J., "Printed Coplanar Two-Antenna Element for 2.4/5 GHz Wlan Operation in MIMO System," Microwave and Optical Technology, v. 50, Jun. 2008, pp. 1635-1638.

Cai, Y. et al., "A Novel Wideband Diversity Antenna for Mobile Handsets," Microwave and Optical Technology Letters, v. 51, Jan. 2009, pp. 218-222.

Choi, J. et al., "Performance Evaluation of 2×2 MIMO Handset Antenna Arrays for Mobile WiMAX Applications," Microwave and Optical Technology Letters, v. 51, Jun. 2009, pp. 1558-1561.

Su, S., "A Three-in-one Diversity Antenna System for 5 GHz WLAN Applications," Microwave and Optical Technology Letters, v. 51, Oct. 2009, pp. 2477-2481.

Kant, T. et al., "Isolation Improvement of 2.4/5.2/5.8 GHz WLAN Internal Laptop Computer Antennas Using Dual-Band Strip Resonator as a Wavetrap," Microwave and Optical Technology Letters, v. 52, Jan. 2010, pp. 58-64.

Su, S., "Concurrent Dual-Band Six-Loop-Antenna System with Wide 3-dB Beamwidth Radiation for MIMO Access Points," Microwave and Optical Technology Letters, v. 52, Jun. 2010, pp. 1253-1258.

Bae, H., et al., "Compact Mobile Handset MIMO Antenna for LTE700 Applications," Microwave and Optical Technolog Letters, v. 52, Nov. 2010, pp. 2419-2422.

Han, M., et al., "MIMO Antenna Using a Decoupling Network for 4G USB Dongle Application," Microwave and Optical Technology Letters, v. 52, Nov. 2010, pp. 2551-2554.

Kim, D., et al., "Design of a Dual-Band MIMO Antenna for Mobile WiMAX Application," Microwave and Optical Technology Letters, v. 53, Feb. 2011, pp. 410-414.

* cited by examiner

MULTI-ANTENNA COMMUNICATION DEVICE

CROSS-REFERENCE TO RELATED APPLICATION

This application claims under 35 U.S.C. § 119(a) the benefit of Taiwanese Patent Application No. 105143339 filed Dec. 27, 2016, the entire contents of which are incorporated herein by reference.

TECHNICAL FIELD

The disclosure relates to communication devices, and relates to a multi-antenna communication device that increases data transmission speed/throughput.

BACKGROUND

The demands for better quality of signals in wireless communication and higher transmission speed/throughput fuel the rapid development of multi-antenna array technology that is applicable to communication devices, such as Multi-Input Multi-Output (MIMO) antenna system or beamforming antenna array system technology. MIMO antenna system has the potential to increase spectrum efficiency and significantly increase channel capacity and data transmission speed. It also has the potential to enhance the reliability of receiving signals at the terminal communication devices. It has become one of the promising technology candidates used in upcoming fifth generation (5G) mobile communication system. For example, under an 8×8 MIMO system, the spectrum efficiency may reach about 37 bps/Hz (20 dB signal-to-noise ratio condition), which is about 4 times that of a 2×2 MIMO system.

However, it remains a challenge to realize a multi-antenna array system in a single space-limited handheld communication device while achieving good radiation characteristic and antenna efficiency for each individual antenna. This would be an important issue need to be solved in the near future. When a plurality of antennas operating in the same frequency band are co-designed and integrated in a communication device with limited space, the envelope correlation coefficient (ECC) between the multiple antennas would greatly increase, resulting in attenuation of the antenna radiation performance and a reduction in the speed/throughput of data transmission, making integration of multi-antenna design a challenging task.

Some previous technology documents have proposed a design scheme that increases energy isolation between multiple antennas by providing a protruding or recessed structure on a ground plane between the multiple antennas as an energy isolator. However, such a design may lead to excitation of additional coupling currents, causing an increase in the correlation coefficients between the multiple antennas, and possibly an increase in the overall size of the multi-antenna array. This is not desirable for commercial terminal communication devices, which require high efficiency and downsized multi-antenna array designs.

Therefore, there is a need for a design that solve the above-mentioned problems in order to meet the demand for high data transmission speed/throughput in future multi-antenna communication devices.

SUMMARY

According to an embodiment, the disclosure provides a multi-antenna communication device, which may include a grounding conductor plane and a four-antenna array. The grounding conductor plane separates a first side space and a second side space opposite to the first side space, and includes a first edge. The four-antenna array may be located at the first edge and has an overall maximum array length extending along the first edge. The four-antenna array may include a first antenna, a second antenna, a third antenna and a fourth antenna. The first antenna may be located in the first side space, and include a first feeding conductor line, a first grounding conductor line, and a first radiating conductor portion electrically connected with a first signal source via the first feeding conductor line and electrically connected with the first edge via the first grounding conductor line, thereby forming a first loop path and generating at least one first resonant mode. The first radiating conductor portion has a first projection line segment at the first edge. The second antenna may be located in the first side space, and include a second feeding conductor line, a second grounding conductor line, and a second radiating conductor portion electrically connected with a second signal source via the second feeding conductor line and electrically connected with the first edge via the second grounding conductor line, thereby forming a second loop path and generating at least one second resonant mode. The second radiating conductor portion has a second projection line segment at the first edge. The third antenna may be located at the second side space, and include a third feeding conductor line, a third grounding conductor line, and a third radiating conductor portion electrically connected with a third signal source via the third feeding conductor line and electrically connected with the first edge via the third grounding conductor line, thereby forming a third loop path and generating at least one third resonant mode. The third radiating conductor portion has a third projection line segment at the first edge. The fourth antenna may be located at the second side space, and include a fourth feeding conductor line, a fourth grounding conductor line, and a fourth radiating conductor portion electrically connected with a fourth signal source via the fourth feeding conductor line and electrically connected with the first edge via the fourth grounding conductor line, thereby forming a fourth loop path and generating at least one fourth resonant mode. The fourth radiating conductor portion has a fourth projection line segment at the first edge. The first projection line segment and the third projection line segment partially overlapped. The second projection line segment and the fourth projection line segment are partially overlapped. The first, second, third and fourth resonant modes cover at least one identical first communication band, and the overall maximum array length of the four-antenna array along the first edge is between 0.25 wavelength and 0.49 wavelength of the lowest operating frequency of the first communication band.

DRAWINGS

Figure 6A:
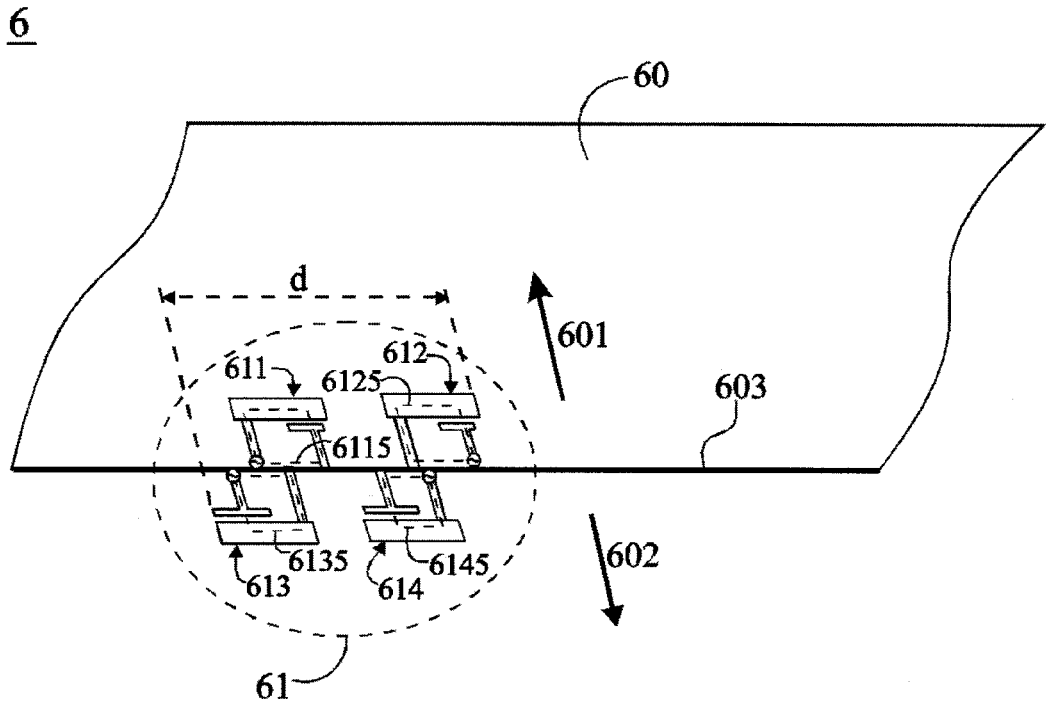
Figure 6B:
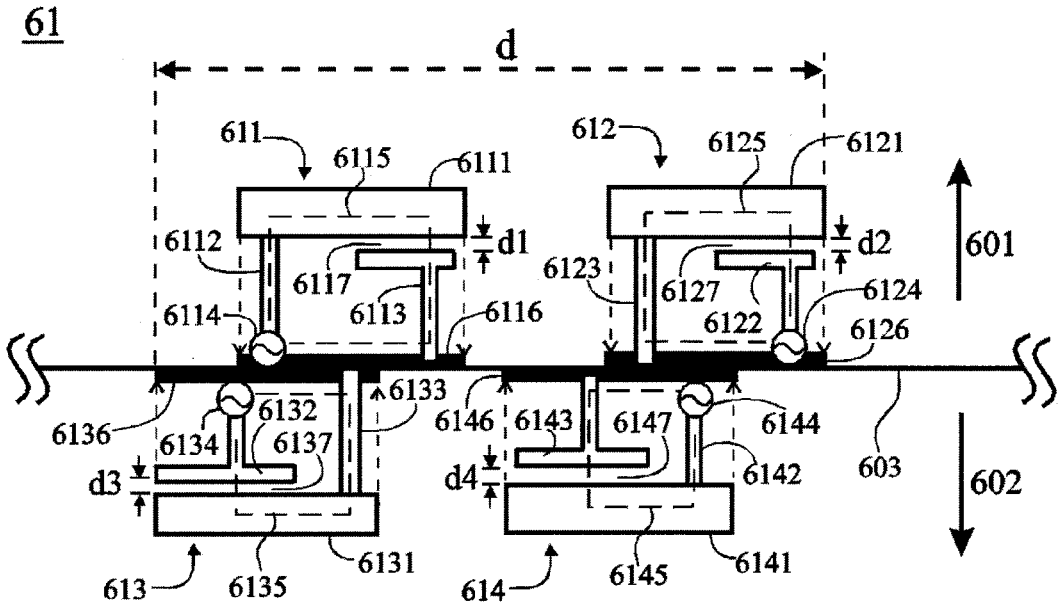

FIG. 6A is a structural diagram depicting a multi-antenna communication device 6 in accordance with an embodiment of the disclosure; and FIG. 6B is a structural diagram depicting a four-antenna array 61 of the multi-antenna communication device 6 in accordance with an embodiment of the disclosure.

DETAILED DESCRIPTION

The disclosure provides embodiments of a multi-antenna communication device, which includes a grounding conductor plane and a four-antenna array. The grounding conductor plane separates a first side space and a second side space opposite to the first side space, and has a first edge. The four-antenna array is located at the first edge, and has an overall maximum array length extending along the first edge. In the four-antenna array, by providing four adjacent and downsized loop paths at the first edge, the grounding conductor plane could be effectively excited to create a more uniform strong current distribution, thus producing respective resonant modes. This effectively reduces the variation of input impedance of the four-antenna array with frequencies, and increases the respective operating bandwidths of the resonant modes. Moreover, the four-antenna array is configured with two loop paths in the first side space, and two loop paths in the second side space. The two adjacent and downsized loop paths in the first side space are able to effectively excite opposite current distributions along the first edge. The two adjacent and downsized loop paths in the second side space also able to effectively excite opposite current distributions along the first edge. As such, the envelope correlation coefficient between two adjacent downsized loop paths in the same side space could be effectively reduced, and the distance between the two adjacent downsized loop paths could thus be effectively reduced, resulting in a reduction in the maximum array length of the four-antenna array along the first edge. Furthermore, in the four-antenna array, by configuring projection line segments corresponding to two adjacent and downsized loop paths in different (the first and second) side spaces to be not completely overlapped with each other, the space wave energy coupling between adjacent downsized loop paths in the first side space and the second side space could be effectively reduced, resulting in a further reduction in the overall size of the four-antenna array and an improvement in the antenna radiation performance. The disclosure provides an integrated multi-antenna communication device with low correlation coefficient, which effectively reduces the overall size of the multi-antenna array applied in the communication device and satisfies the need for high speed/throughput data transmission in upcoming multi-antenna communication devices.

Figure 1A:
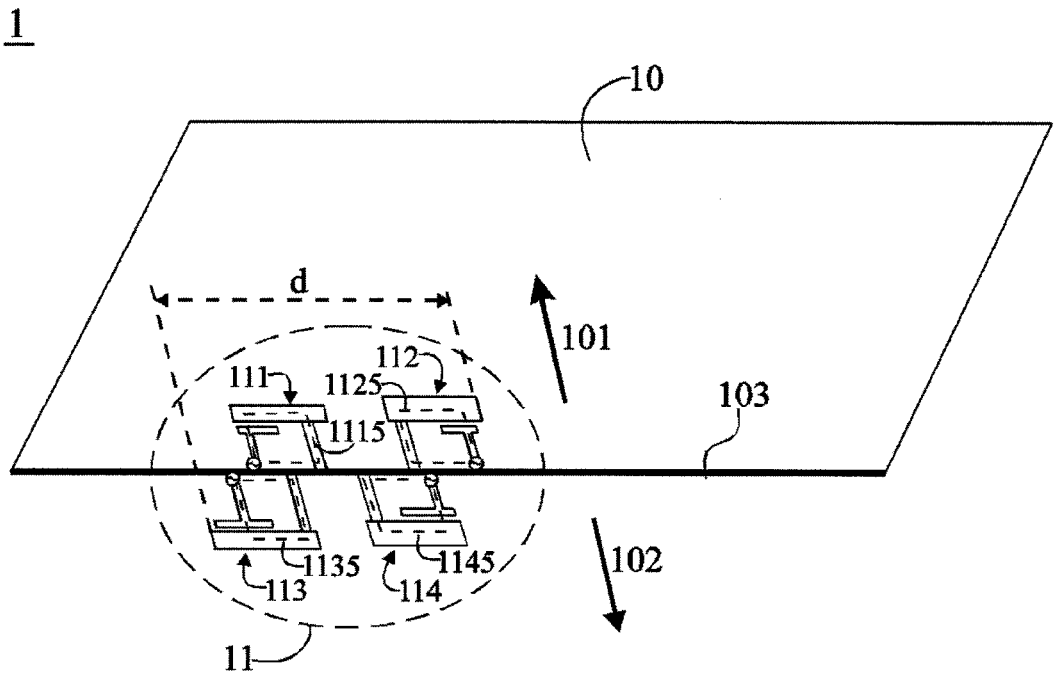
FIG. 1A is a structural diagram depicting a multi-antenna communication device 1 in accordance with an embodiment of the disclosure.
Figure 1B:
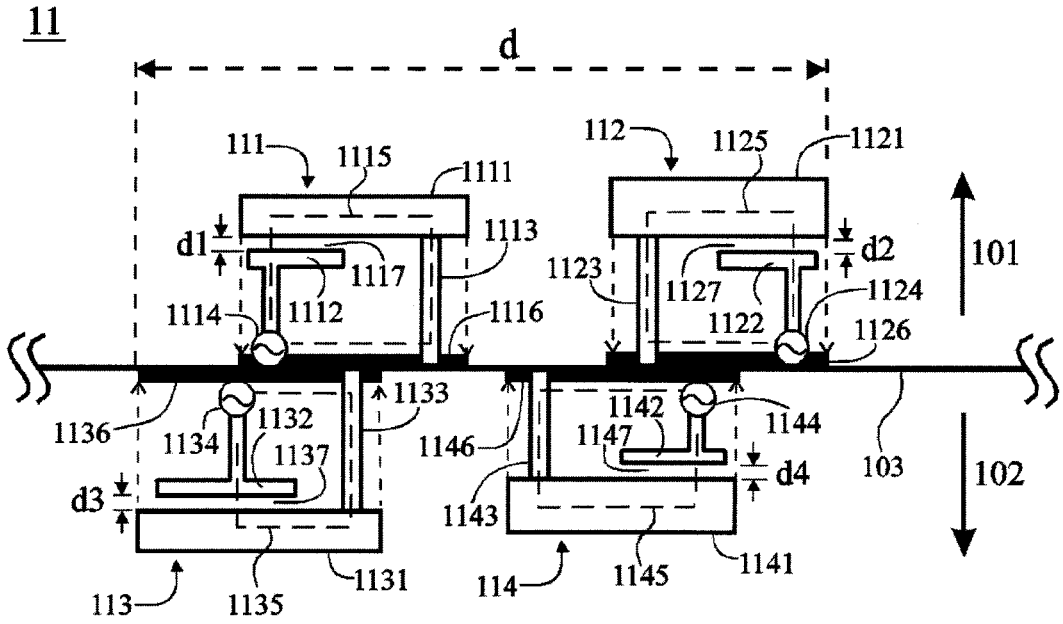
FIG. 1B is a structural diagram depicting a four-antenna array 11 of the multi-antenna communication device 1 in accordance with an embodiment of the disclosure.
Figure 1C:
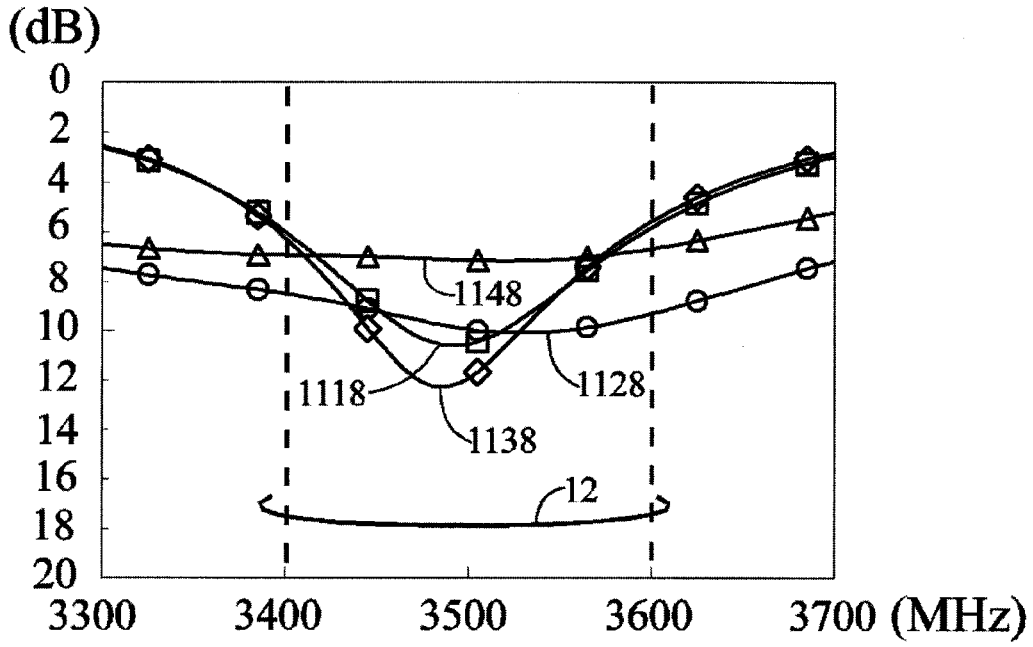
FIG. 1C is a graph showing return loss of the four-antenna array 11 of the multi-antenna communication device 1 in accordance with an embodiment of the disclosure.

FIG. 1A is a structural diagram depicting a multi-antenna communication device 1 in accordance with an embodiment of the disclosure. FIG. 1B is a structural diagram depicting a four-antenna array 11 of the multi-antenna communication device 1 in accordance with an embodiment of the disclosure. FIG. 1C is a graph showing return loss of the four-antenna array 11 of the multi-antenna communication device 1 in accordance with an embodiment of the disclosure. The multi-antenna communication device 1 includes a grounding conductor plane 10 and a four-antenna array 11. The grounding conductor plane 10 separates a first side space 101 and a second side space 102 opposite to the first side space 101, and has a first edge 103. The four-antenna array 11 is located at the first edge 103, and has an overall maximum array length d extending along the first edge 103. As shown in FIGS. 1A and 1B, the four-antenna array 11 includes a first antenna 111, a second antenna 112, a third antenna 113 and a fourth antenna 114. As shown in FIG. 1B, the first antenna 111 is located in the first side space 101, and includes a first feeding conductor line 1112, a first grounding conductor line 1113, and a first radiating conductor portion 1111 electrically connected with a first signal source 1114 via the first feeding conductor line 1112 and electrically connected with the first edge 103 via the first grounding conductor line 1113, thereby forming a first loop path 1115 and generating at least one first resonant mode 1118 (as shown in FIG. 1C). The first radiating conductor portion 1111 has a first projection line segment 1116 at the first edge 103. The first loop path 1115 begins at the first signal source 1114, passes through the first feeding conductor line 1112, the first radiating conductor portion 1111, the first grounding conductor line 1113 and the first edge 103, and returns to the first signal source 1114. The second antenna 112 is located in the first side space 101, and includes a second feeding conductor line 1122, a second grounding conductor line 1123, and a second radiating conductor portion 1121 electrically connected with a second signal source 1124 via the second feeding conductor line 1122 and electrically connected with the first edge 103 via the second grounding conductor line 1123, thereby forming a second loop path 1125 and generating at least one second resonant mode 1128 (as shown in FIG. 1C). The second radiating conductor portion 1121 has a second projection line segment 1126 at the first edge 103. The second loop path 1125 begins at the second signal source 1124, passes through the second feeding conductor line 1122, the second radiating conductor portion 1121, the second grounding conductor line 1123 and the first edge 103, and returns to the second signal source 1124. The third antenna 113 is located in the second side space 102, and includes a third feeding conductor line 1132, a third grounding conductor line 1133, and a third radiating conductor portion 1131 electrically connected with a third signal source 1134 via the third feeding conductor line 1132 and electrically connected with the first edge 103 via the third grounding conductor line 1133, thereby forming a third loop path 1135 and generating at least one third resonant mode 1138 (as shown in FIG. 1C). The third radiating conductor portion 1131 has a third projection line segment 1136 at the first edge 103. The third loop path 1135 begins at the third signal source 1134, passes through the third feeding conductor line 1132, the third radiating conductor portion 1131, the third grounding conductor line 1133 and the first edge 103, and returns to the third signal source 1134. The fourth antenna 114 is located in the second side space 102, and includes a fourth feeding conductor line 1142, a fourth grounding conductor line 1143, and a fourth radiating conductor portion 1141 electrically connected with a fourth signal source 1144 via the fourth feeding conductor line 1142 and electrically connected with the first edge 103 via the fourth grounding conductor line 1143, thereby forming a fourth loop path 1145 and generating at least one fourth resonant mode 1148 (as shown in FIG. 1C). The fourth radiating conductor portion 1141 has a fourth projection line segment 1146 at the first edge 103. The fourth loop path 1145 begins at the fourth signal source 1144, passes through the fourth feeding conductor line 1142, the fourth radiating conductor portion 1141, the fourth grounding conductor line 1143 and the first edge 103, and returns to the fourth signal source 1144. The first projection line segment 1116 and the third projection line segment 1136 are partially but not completely overlapped. The second projection line segment 1126 and the fourth projection line segment 1146 are partially but not completely overlapped. The first, second, third, and fourth resonant modes 1118, 1128, 1138 and 1148 cover at least one identical first communication band 12 (as shown in FIG. 1C), and the overall maximum array length d of the four-antenna array 11 along the first edge 103 is between 0.25 wavelength and 0.49 wavelength of the lowest operating frequency of the first communication band 12. The lengths of the first loop path 1115, the second loop path 1125, the third loop path 1135 and the fourth loop path 1145 are all between 0.1 wavelength and 0.369 wavelength of the lowest operating frequency of the first communication band 12. The first feeding conductor line 1112 is spaced from the first radiating conductor portion 1111 at a first coupling gap 1117 that has an interval d1 less than or equal to 0.023 wavelength of the lowest operating frequency of the first communication band 12. The first grounding conductor line 1113 is electrically connected to the first radiating conductor portion 1111. With the first coupling gap 1117, a capacitive reactance could be created that effectively compensates the inductance of the first loop path 1115, thereby successfully reducing the length of the first loop path 1115. The second feeding conductor line 1122 is spaced from the second radiating conductor portion 1121 at a second coupling gap 1127 that has an interval d2 is less than or equal to 0.023 wavelength of the lowest operating frequency of the first communication band 12. The second grounding conductor line 1123 is electrically connected to the second radiating conductor portion 1121. With the second coupling gap 1127, a capacitive reactance could be created that effectively compensates the inductance of the second loop path 1125, thereby successfully reducing the length of the second loop path 1125. The third feeding conductor line 1132 is spaced from the third radiating conductor portion 1131 at a third coupling gap 1137 that has an interval d3 less than or equal to 0.023 wavelength of the lowest operating frequency of the first communication band 12. The third grounding conductor line 1133 is electrically connected to the third radiating conductor portion 1131. With the third coupling gap 1137, a capacitive reactance could be created that effectively compensates the inductance of the third loop path 1135, thereby successfully reducing the length of the third loop path 1135. The fourth feeding conductor line 1142 is spaced from the fourth radiating conductor portion 1141 at a fourth coupling gap 1147 that has an interval d4 less than or equal to 0.023 wavelength of the lowest operating frequency of the first communication band 12. The fourth grounding conductor line 1143 is electrically connected to the fourth radiating conductor portion 1141. With the fourth coupling gap 1147, a capacitive reactance could be created that effectively compensates the inductance of the fourth loop path 1145, thereby successfully reducing the length of the fourth loop path 1145. The lengths of the first radiating conductor portion 1111, the second radiating conductor portion 1121, the third radiating conductor portion 1131 and the fourth radiating conductor portion 1141 are all between 0.05 wavelength and 0.233 wavelength of the lowest operating frequency of the first communication band 12 (as shown in FIG. 1C). The lengths of the first projection line segment 1116, the second projection line segment 1126, the third projection line segment 1136 and the fourth projection line segment 1146 are all between 0.01 wavelength and 0.22 wavelength of the lowest operating frequency of the first communication band 12 (as shown in FIG. 1C). Each of the first signal source 1114, the second signal source 1124, the third signal source 1134 and the fourth signal source 1144 could be a radio frequency circuit module, a radio frequency integrated circuit die, a radio frequency circuit switch, a radio frequency filter circuit, a radio frequency duplexer circuit, a radio frequency transmission line circuit, or a radio frequency capacitance, inductance or resistance matching circuit.

In the four-antenna array 11 of the multi-antenna communication device 1, by providing four adjacent and downsized first loop path 1115, second loop path 1125, third loop path 1135 and fourth loop path 1145 at the first edge 103, the grounding conductor plane 10 is effectively excited to create a more uniform strong current distribution, thus respectively producing the first resonant mode 1118, the second resonant mode 1128, the third resonant mode 1138 and the fourth resonant mode 1148. This effectively reduces the variation of input impedance of the four-antenna array 11 with frequencies, and increases the respective operating bandwidths of the first resonant mode 1118, the second resonant mode 1128, the third resonant mode 1138 and the fourth resonant mode 1148. Moreover, as the four-antenna array 11 is configured with the first loop path 1115 and the second loop path 1125 in the first side space 101, and the third loop path 1135 and the fourth loop path 1145 in the second side space 102, the first loop path 1115 and the second loop path 1125 in the first side space 101 are able to effectively excite opposite current distributions along the first edge 103, and the third loop path 1135 and the fourth loop path 1145 in the second side space 102 are also able to effectively excite opposite current distributions along the first edge 103. As such, the envelope correlation coefficient between two adjacent downsized loop paths in the same side space may be effectively reduced, and the distance between the two adjacent downsized loop paths may be effectively reduced, resulting in a reduction in the maximum array length d of the four-antenna array 11 along the first edge 103. Furthermore, by allowing the first projection line segment 1116 and the third projection line segment 1136 to be partially but not completely overlapped, and the second projection line segment 1126 and the fourth projection line segment 1146 to be partially but not completely overlapped, the space wave energy coupling between adjacent downsized loop paths in the first side space 101 and the second side space 102 may be effectively reduced, resulting in a further reduction in the overall size of the four-antenna array 11 and an improvement in the antenna radiation characteristic.

FIG. 1C is a graph showing return loss of the four-antenna array 11 of the multi-antenna communication device 1 in accordance with an embodiment of the disclosure. The following dimensions are used in the experiments: the four-antenna array 11 having a length of about 150 mm and a width of about 75 mm; the first edge 103 having a length of 150 mm; the first loop path 1115 having a length of about 26 mm, the second loop path 1125 having a length of about 27 mm, the third loop path 1135 having a length of about 25 mm, the fourth loop path 1145 having a length of about 26.5 mm; the maximum array length d of the four-antenna array 11 being about 36 mm; the first coupling gap 1117 having an interval d1 of about 0.3 mm, the second coupling gap 1127 having an interval d2 of about 0.5 mm, the third coupling gap 1137 having an interval d3 of about 0.3 mm, the fourth coupling gap 1147 having an interval d4 of about 0.35 mm; the first radiating conductor portion 1111 having a length of about 10 mm, the second radiating conductor portion 1121 having a length of about 10.5 mm, the third radiating conductor portion 1131 having a length of about 11 mm, the fourth radiating conductor portion 1141 having a length of about 10.5 mm; the maximum array length d of the four-antenna array 11 being about 36 mm; the first projection line segment 1116 having a length of about 10 mm, the second projection line segment 1126 having a length of about 10.5 mm, the third projection line segment 1136 having a length of about 11 mm, the fourth projection line segment 1146 having a length of about 10.5 mm. As shown in FIG. 1C, the first loop path 1115 generates at least one first resonant mode 1118, the second loop path 1125 generates at least one second resonant mode 1128, the third loop path 1135 generates at least one third resonant mode 1138, and the fourth loop path 1145 generates at least one fourth resonant mode 1148. In an embodiment, the first resonant mode 1118, the second resonant mode 1128, the third resonant mode 1138 and the fourth resonant mode 1148 cover the identical first communication band 12 (3400 MHz-3600 MHz). The lowest operating frequency of the first communication band 12 is about 3400 MHz.

Figure 1D:
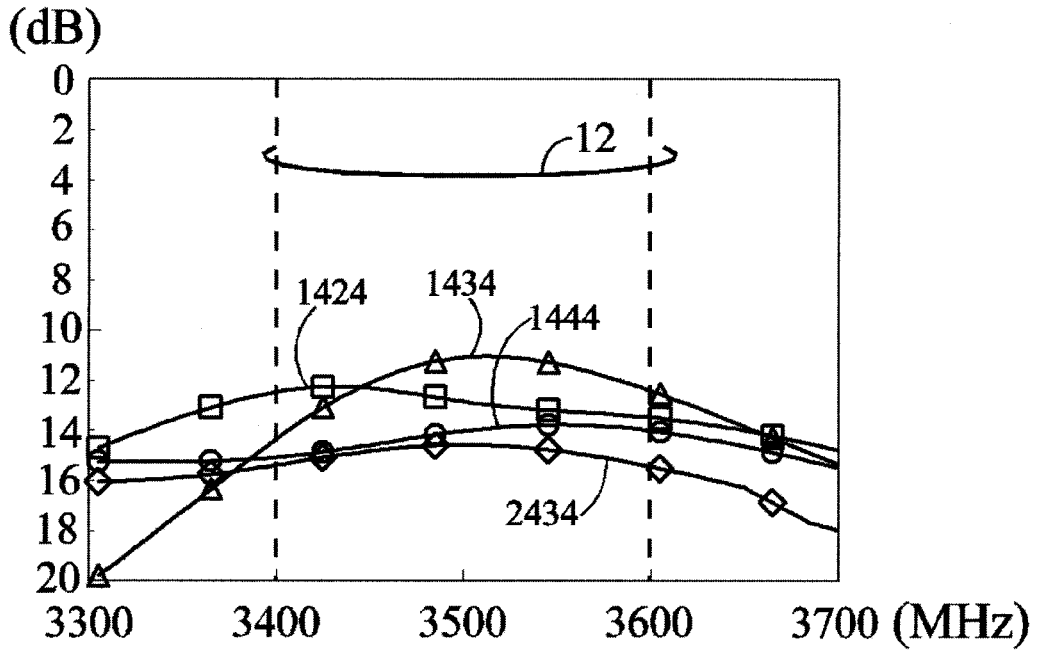
FIG. 1D is a graph showing isolation level of the four-antenna array 11 of the multi-antenna communication device 1 in accordance with an embodiment of the disclosure.
Figure 1E:
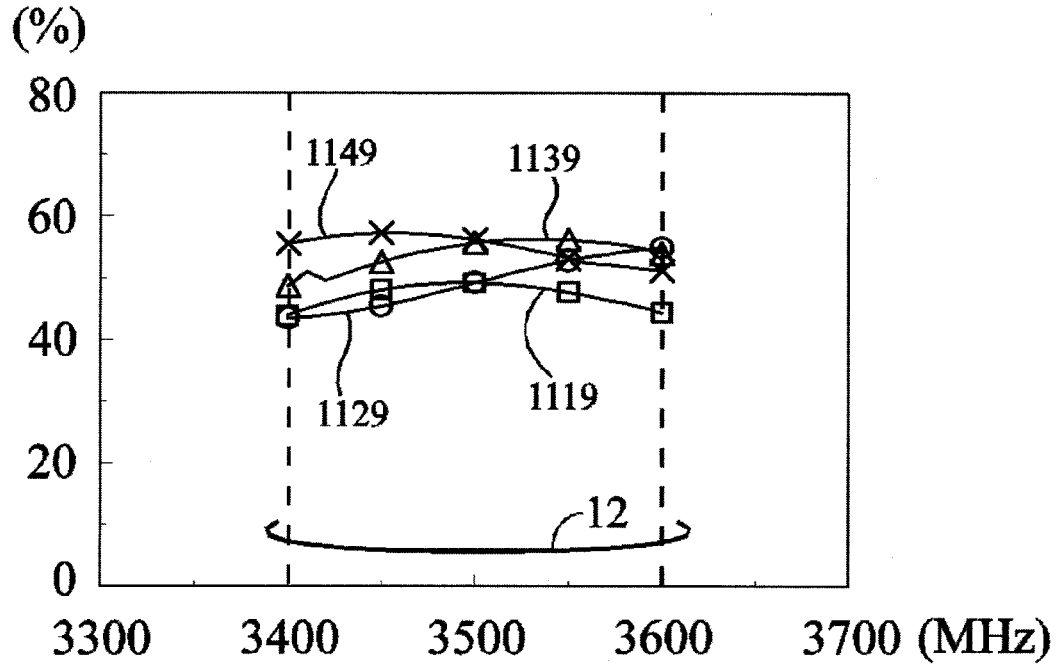
FIG. 1E is a graph showing radiation efficiency of the four-antenna array 11 of the multi-antenna communication device 1 in accordance with an embodiment of the disclosure.
Figure 1F:
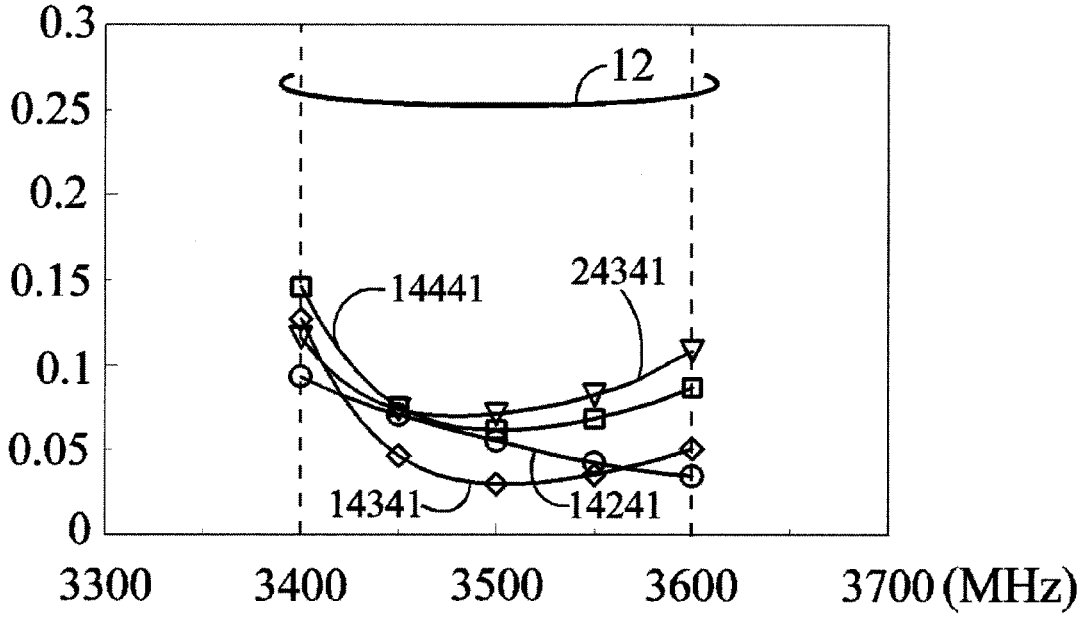
FIG. 1F is a graph showing envelope correlation coefficient of the four-antenna array of the multi-antenna communication device 1 in accordance with an embodiment of the disclosure.

FIG. 1D is a graph showing isolation level of the four-antenna array 11 of the multi-antenna communication device 1 in accordance with an embodiment of the disclosure. The isolation level between the first antenna 111 and the second antenna 112 is shown by a curve 1424, the isolation level between the first antenna 111 and the third antenna 113 is shown by a curve 1434, the isolation level between the first antenna 111 and the fourth antenna 114 is shown by a curve 1444, and the isolation level between the second antenna 112 and the third antenna 113 is shown by a curve 2434. As shown in FIG. 1D, the curves of isolation level of the four-antenna array 11 in the first communication band 12 are all above 10 dB. FIG. 1E is a graph showing radiation efficiency of the four-antenna array 11 of the multi-antenna communication device 1 in accordance with an embodiment of the disclosure. The radiation efficiency of the first antenna 111 is shown by a curve 1119, the radiation efficiency of the second antenna 112 is shown by a curve 1129, the radiation efficiency of the third antenna 113 is shown by a curve 1139, and the radiation efficiency of the fourth antenna 114 is shown by a curve 1149. As shown in FIG. 1E, the radiation efficiency curves of the four-antenna array 11 in the first communication band 12 are all above 40%. FIG. 1F is a graph showing envelope correlation coefficient of the four-antenna array 11 of the multi-antenna communication device 1 in accordance with an embodiment of the disclosure. The envelope correlation coefficient between the first antenna 111 and the second antenna 112 is shown by a curve 14241, the envelope correlation coefficient between the first antenna 111 and the third antenna 113 is shown by a curve 14341, the envelope correlation coefficient between the first antenna 111 and the fourth antenna 114 is shown by a curve 14441, and the envelope correlation coefficient between the second antenna 112 and the third antenna 113 is shown by a curve 24341. As shown in FIG. 1F, the envelope correlation coefficient curves of the four-antenna array 11 in the first communication band 12 are all below 0.2.

The communication system operating band and experiment data described with respect to FIGS. 1C, 1D, 1E and 1F are merely to experimentally prove the technical effects of the multi-antenna communication device 1 according to the disclosure shown in FIGS. 1A and 1B, and do not intend to limit the communication operating bands, the applications and the specifications of the multi-antenna communication device of the disclosure in actual implementations. The multi-antenna communication device 1 according to the disclosure could be designed to cover system operating bands in WWAN (Wireless Wide Area Network), MIMO (Multi-input Multi-output) system, LTE (Long Term Evolution), pattern switchable antenna system, WLPN (Wireless Personal Network), WLAN (Wireless Local Area Network), beamforming antenna system, NFC (Near Field Communication), DTV (Digital Television Broadcasting System) or GPS (Global Positioning System). The four-antenna array 11 could be realized as a single set or multiple sets in the multi-antenna communication device 1 according to the disclosure. The multi-antenna communication device 1 could be a mobile communication device, a wireless communication device, a mobile computing device, a computer system, a telecommunication apparatus, a network apparatus or a computer or network peripheral.

Figure 2A:
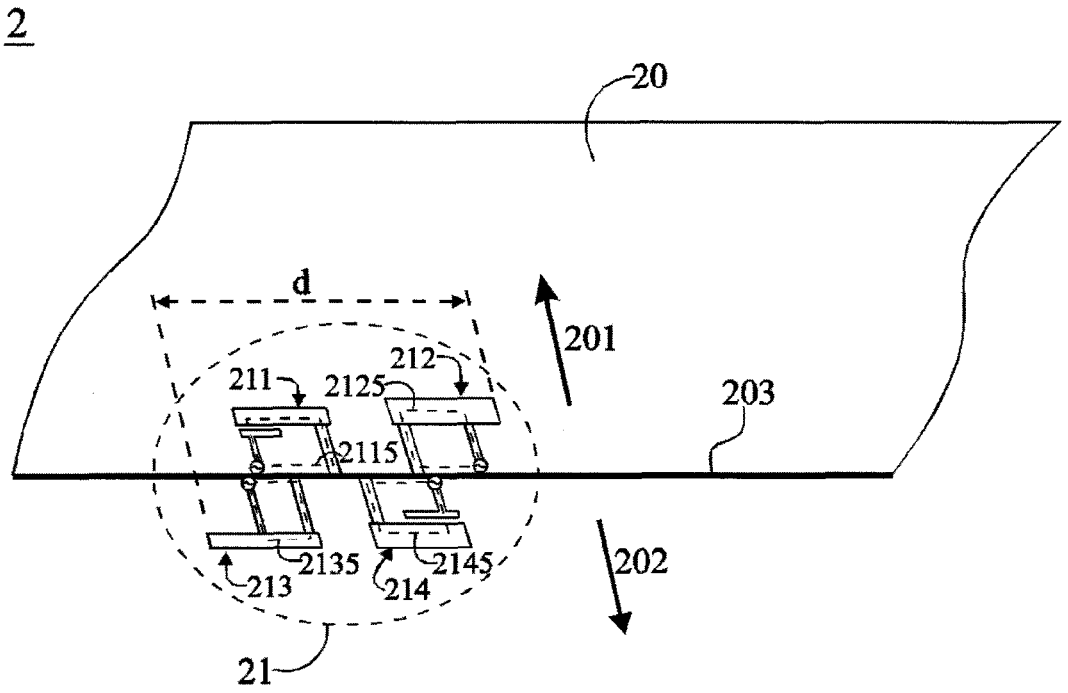
FIG. 2A is a structural diagram depicting a multi-antenna communication device 2 in accordance with an embodiment of the disclosure.
Figure 2B:
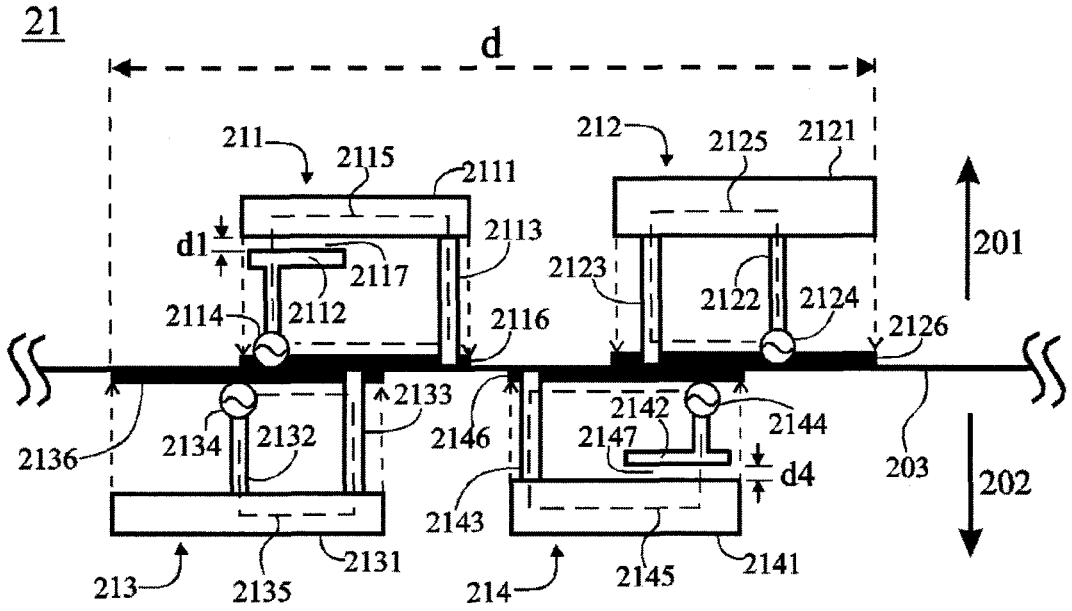
FIG. 2B is a structural diagram depicting a four-antenna array 21 of the multi-antenna communication device 2 in accordance with an embodiment of the disclosure.
Figure 2C:
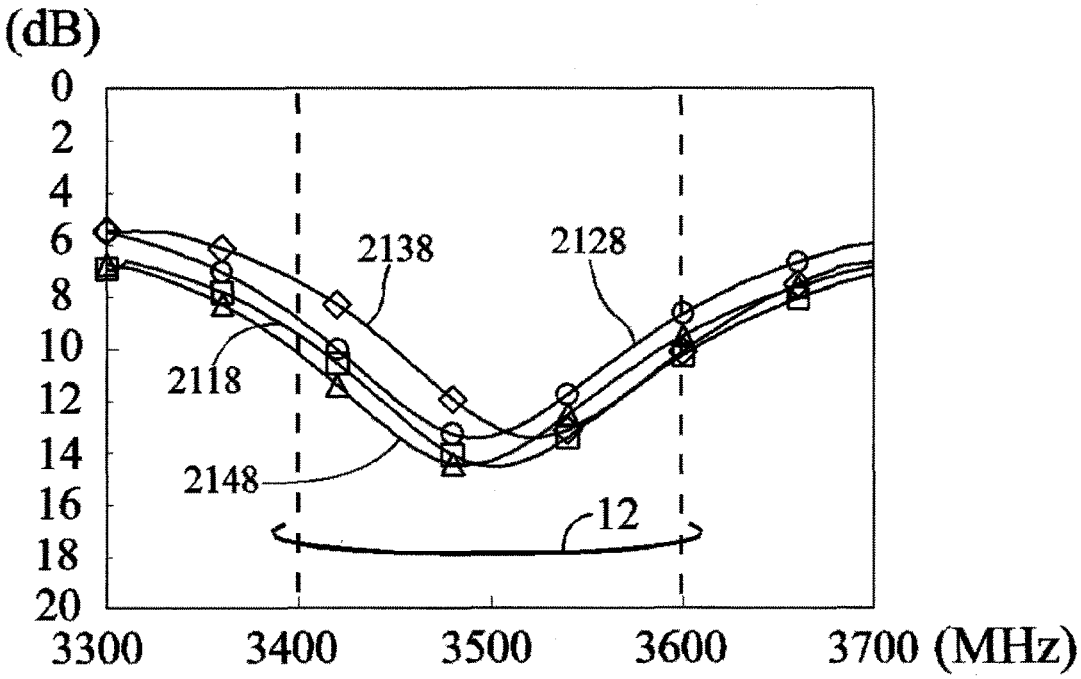
FIG. 2C is a graph showing return loss of the four-antenna array 21 of the multi-antenna communication device 2 in accordance with an embodiment of the disclosure.

FIG. 2A is a structural diagram depicting a multi-antenna communication device 2 in accordance with an embodiment of the disclosure. FIG. 2B is a structural diagram depicting a four-antenna array 21 of the multi-antenna communication device 2 in accordance with an embodiment of the disclosure. FIG. 2C is a graph showing return loss of the four-antenna array 21 of the multi-antenna communication device 2 in accordance with an embodiment of the disclosure. As shown in FIG. 2A, the multi-antenna communication device 2 includes a grounding conductor plane 20 and a four-antenna array 21. The grounding conductor plane 20 separates a first side space 201 and a second side space 202 opposite to the first side space 201, and has a first edge 203. The four-antenna array 21 is located in the first edge 203, and has an overall maximum array length d extending along the first edge 203. As shown in FIGS. 2A and 2B, the four-antenna array 21 includes a first antenna 211, a second antenna 212, a third antenna 213 and a fourth antenna 214. As shown in FIG. 2B, the first antenna 211 is located in the first side space 201, and includes a first feeding conductor line 2112, a first grounding conductor line 2113, and a first radiating conductor portion 2111 electrically connected with a first signal source 2114 via the first feeding conductor line 2112 and electrically connected with the first edge 203 via the first grounding conductor line 2113, thereby forming a first loop path 2115 and generating at least one first resonant mode 2118 (as shown in FIG. 2C). The first radiating conductor portion 2111 has a first projection line segment 2116 at the first edge 203. The first loop path 2115 begins at the first signal source 2114, passes through the first feeding conductor line 2112, the first radiating conductor portion 2111, the first grounding conductor line 2113 and the first edge 203, and returns to the first signal source 2114. The second antenna 212 is located in the first side space 201, and includes a second feeding conductor line 2122, a second grounding conductor line 2123, and a second radiating conductor portion 2121 electrically connected with a second signal source 2124 via the second feeding conductor line 2122 and electrically connected with the first edge 203 via the second grounding conductor line 2123, thereby forming a second loop path 2125 and generating at least one second resonant mode 2128 (as shown in FIG. 2C). The second radiating conductor portion 2121 has a second projection line segment 2126 at the first edge 203. The second loop path 2125 begins at the second signal source 2124, passes through the second feeding conductor line 2122, the second radiating conductor portion 2121, the second grounding conductor line 2123 and the first edge 203, and returns to the second signal source 2124. The third antenna 213 is located in the second side space 202, and includes a third feeding conductor line 2132, a third grounding conductor line 2133, and a third radiating conductor portion 2131 electrically connected with a third signal source 2134 via the third feeding conductor line 2132 and electrically connected with the first edge 203 via the third grounding conductor line 2133, thereby forming a third loop path 2135 and generating at least one third resonant mode 2138 (as shown in FIG. 2C). The third radiating conductor portion 2131 has a third projection line segment 2136 at the first edge 203. The third loop path 2135 begins at the third signal source 2134, passes through the third feeding conductor line 2132, the third radiating conductor portion 2131, the third grounding conductor line 2133 and the first edge 203, and returns to the third signal source 2134. The fourth antenna 214 is located in the second side space 202, and includes a fourth feeding conductor line 2142, a fourth grounding conductor line 2143, and a fourth radiating conductor portion 2141 electrically connected with a fourth signal source 2144 via the fourth feeding conductor line 2142 and electrically connected with the first edge 203 via the fourth grounding conductor line 2143, thereby forming a fourth loop path 2145 and generating at least one fourth resonant mode 2148 (as shown in FIG. 2C). The fourth radiating conductor portion 2141 has a fourth projection line segment 2146 at the first edge 203. The fourth loop path 2145 begins at the fourth signal source 2144, passes through the fourth feeding conductor line 2142, the fourth radiating conductor portion 2141, the fourth grounding conductor line 2143 and the first edge 203, and returns to the fourth signal source 2144. The first projection line segment 2116 and the third projection line segment 2136 are partially but not completely overlapped. The second projection line segment 2126 and the fourth projection line segment 2146 are partially but not completely overlapped. The first, second, third, and fourth resonant modes 2118, 2128, 2138 and 2148 cover at least one identical first communication band 12 (as shown in FIG. 2C), and the overall maximum array length d of the four-antenna array 21 along the first edge 203 is between 0.25 wavelength and 0.49 wavelength of the lowest operating frequency of the first communication band 12. The lengths of the first loop path 2115, the second loop path 2125, the third loop path 2135 and the fourth loop path 2145 are all between 0.1 wavelength and 0.369 wavelength of the lowest operating frequency of the first communication band 12. The first feeding conductor line 2112 is spaced from the first radiating conductor portion 2111 at a first coupling gap 2117 that has an interval d1 less than or equal to 0.023 wavelength of the lowest operating frequency of the first communication band 12. The first grounding conductor line 2113 is electrically connected to the first radiating conductor portion 2111. With the first coupling gap 2117, a capacitive reactance could be created that effectively compensates the inductance of the first loop path 2115, thereby successfully reducing the required length of the first loop path 2115. The second feeding conductor line 2122 and the second grounding conductor line 2123 are electrically connected to the second radiating conductor portion 2121. The third feeding conductor line 2132 and the third grounding conductor line 2133 are electrically connected to the third radiating conductor portion 2131. The fourth feeding conductor line 2142 is spaced from the fourth radiating conductor portion 2141 at a fourth coupling gap 2147 that has an interval d4 less than or equal to 0.023 wavelength of the lowest operating frequency of the first communication band 12 (shown in FIG. 2C). The fourth grounding conductor line 2143 is electrically connected to the fourth radiating conductor portion 2141. With the fourth coupling gap 2147, a capacitive reactance could be created that effectively compensates the inductance of the fourth loop path 2145, thereby successfully reducing the required length of the fourth loop path 2145. The lengths of the first radiating conductor portion 2111, the second radiating conductor portion 2121, the third radiating conductor portion 2131 and the fourth radiating conductor portion 2141 are all between 0.05 wavelength and 0.233 wavelength of the lowest operating frequency of the first communication band 12 (as shown in FIG. 2C). The lengths of the first projection line segment 2116, the second projection line segment 2126, the third projection line segment 2136 and the fourth projection line segment 2146 are all between 0.01 wavelength and 0.22 wavelength of the lowest operating frequency of the first communication band 12 (as shown in FIG. 2C). Each of the first signal source 2114, the second signal source 2124, the third signal source 2134 and the fourth signal source 2144 could be a radio frequency circuit module, a radio frequency integrated circuit, a radio frequency circuit switch, a radio frequency filter circuit, a radio frequency duplexer circuit, a radio frequency transmission line circuit, or a radio frequency capacitance, inductance or resistance matching circuit.

In the four-antenna array 21 of the multi-antenna communication device 2, although the second radiating conductor portion 2121 is shaped different from the second radiating conductor portion 1121 in the multi-antenna communication device 1, the second feeding conductor line 2122 is electrically connected with the second radiating conductor portion 2121, the third radiating conductor portion 2131 is shaped different from the third radiating conductor portion 1131 in the multi-antenna communication device 1, and the third feeding conductor line 2132 is electrically connected with the third radiating conductor portion 2131, when the second signal source 2124 and the third signal source 2134 are radio frequency capacitance matching circuits, capacitive reactance can also be generated, which effectively compensate the inductances of the second loop path 2125 and the third loop path 2135, thereby successfully reducing the lengths of the second loop path 2125 and the third loop path 2135. Therefore, by providing four adjacent and downsized first loop path 2115, second loop path 2125, third loop path 2135 and fourth loop path 2145 at the first edge 203, the multi-antenna communication device 2 can effectively excite the grounding conductor plane 20 to create a more uniform strong current distribution, thus respectively producing the first resonant mode 2118, the second resonant mode 2128, the third resonant mode 2138 and the fourth resonant mode 2148. This also effectively reduces the variation of input impedance of the four-antenna array 21 with the frequencies, and increases the respective operating bandwidths of the first resonant mode 2118, the second resonant mode 2128, the third resonant mode 2138 and the fourth resonant mode 2148. Moreover, as the four-antenna array 21 is configured with the first loop path 2115 and the second loop path 2125 at the first side space 201, and the third loop path 2135 and the fourth loop path 2145 at the second side space 202, the first loop path 2115 and the second loop path 2125 at the first side space 201 are able to effectively excite opposite current distributions along the first edge 203, and the third loop path 2135 and the fourth loop path 2145 at the second side space 202 are also able to effectively excite opposite current distributions along the first edge 203. As such, the envelope correlation coefficient between two adjacent downsized loop paths at the same side space could be effectively reduced, and the distance between the two adjacent downsized loop paths could be effectively reduced, resulting in a reduction in the maximum array length d of the four-antenna array 21 along the first edge 203. Furthermore, by allowing the first projection line segment 2116 and the third projection line segment 2136 to partially but not completely overlap, and the second projection line segment 2126 and the fourth projection line segment 2146 to partially but not completely overlap, the space wave energy coupling between adjacent downsized loop paths at the first side space 201 and the second side space 202 could be effectively reduced, resulting in a further reduction in the overall size of the four-antenna array 21 and an improvement in the antenna radiation characteristic. Thus, the multi-antenna communication device 2 achieves similar technical effect/performance provided by the multi-antenna communication device 1.

FIG. 2C is a graph showing return loss of the four-antenna array 21 of the multi-antenna communication device 2 in accordance with an embodiment of the disclosure. The following dimensions are used in the experiments: the first edge 203 having a length of 160 mm; the first loop path 2115 having a length of about 26 mm, the second loop path 2125 having a length of about 18 mm, the third loop path 2135 having a length of about 17.5 mm, the fourth loop path 2145 having a length of about 26 mm; the maximum array length d of the four-antenna array 21 being about 40 mm; the first coupling gap 2117 having an interval d1 of about 0.3 mm, the fourth coupling gap 2147 having an interval d4 of about 0.3 mm; the first radiating conductor portion 2111 having a length of about 11 mm, the second radiating conductor portion 2121 having a length of about 16 mm, the third radiating conductor portion 2131 having a length of about 17 mm, the fourth radiating conductor portion 2141 having a length of about 10.5 mm; the maximum array length d of the four-antenna array 21 being about 36 mm; the first projection line segment 2116 having a length of about 11 mm, the second projection line segment 2126 having a length of about 16 mm, the third projection line segment 2136 having a length of about 17 mm, the fourth projection line segment 2146 having a length of about 10.5 mm. As shown in FIG. 2C, the first loop path 2115 generates at least one first resonant mode 2118, the second loop path 2125 generates at least one second resonant mode 2128, the third loop path 2135 generates at least one third resonant mode 2138, and the fourth loop path 2145 generates at least one fourth resonant mode 2148. In this embodiment, the first resonant mode 2118, the second resonant mode 2128, the third resonant mode 2138 and the fourth resonant mode 2148 cover the identical first communication band 12 (3400 MHz-3600 MHz). The lowest operating frequency of the first communication band 12 is about 3400 MHz.

Figure 2D:
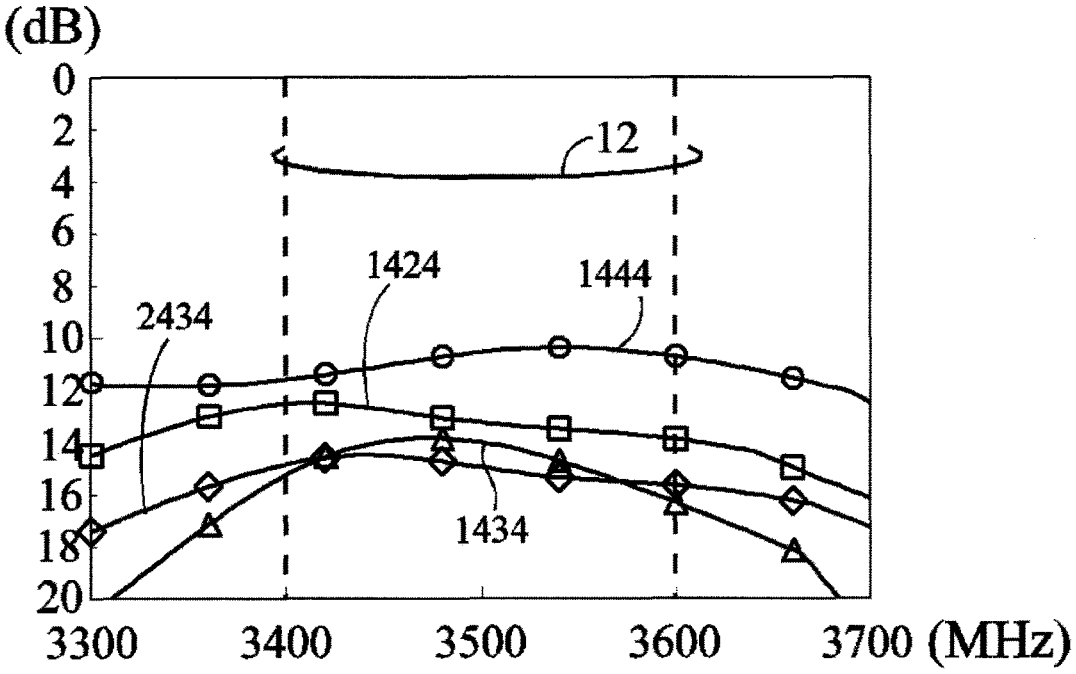
FIG. 2D is a graph showing isolation level of the four-antenna array 21 of the multi-antenna communication device 2 in accordance with an embodiment of the disclosure.
Figure 2E:
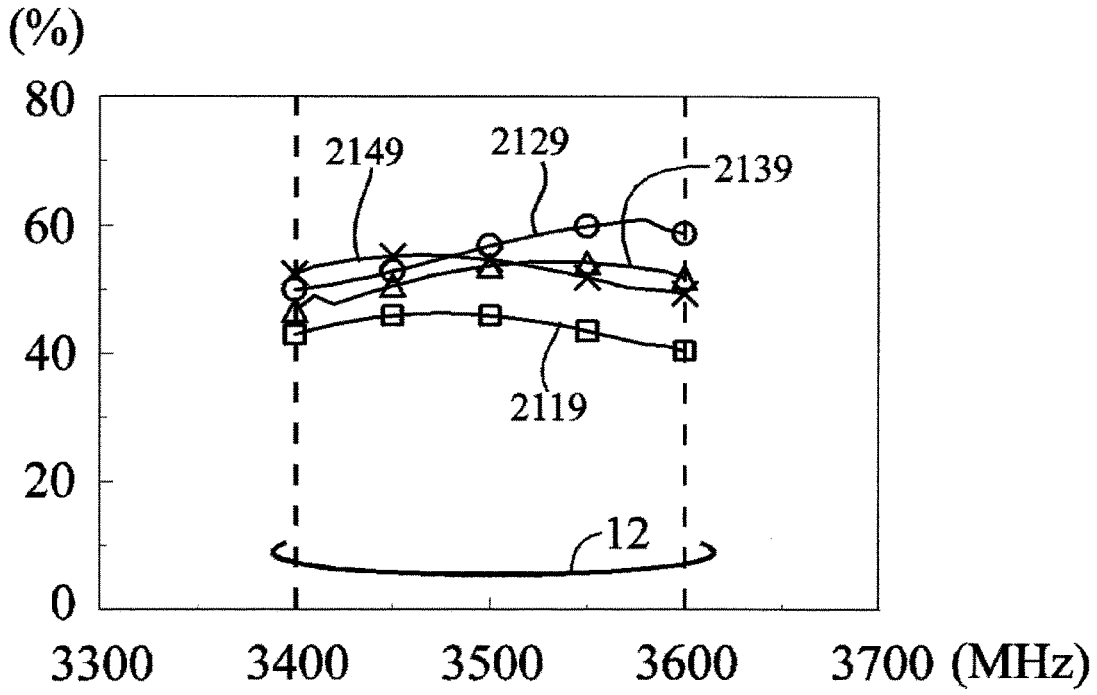
FIG. 2E is a graph showing radiation efficiency of the four-antenna array 21 of the multi-antenna communication device 2 in accordance with an embodiment of the disclosure.
Figure 2F:
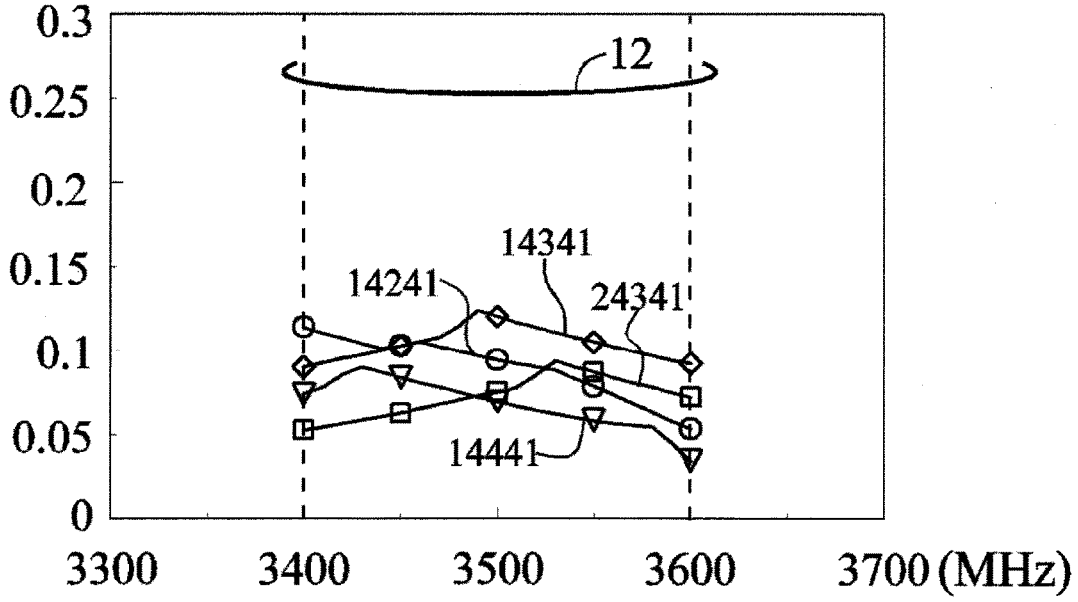
FIG. 2F is a graph showing envelope correlation coefficient of the four-antenna array 21 of the multi-antenna communication device 2 in accordance with an embodiment of the disclosure.

FIG. 2D is a graph showing the isolation level of the four-antenna array 21 of the multi-antenna communication device 2 in accordance with an embodiment of the disclosure. The isolation level between the first antenna 211 and the second antenna 212 is shown by a curve 1424, the isolation level between the first antenna 211 and the third antenna 213 is shown by a curve 1434, the isolation level between the first antenna 211 and the fourth antenna 214 is shown by a curve 1444, the isolation level between the second antenna 212 and the third antenna 213 is shown by a curve 2434. As shown in FIG. 2D, the curves of isolation level of the four-antenna array 21 in the first communication band 12 are all above 10 dB. FIG. 2E is a graph showing radiation efficiency of the four-antenna array 21 of the multi-antenna communication device 2 in accordance with an embodiment of the disclosure. The radiation efficiency of the first antenna 211 is shown by a curve 2119, the radiation efficiency of the second antenna 212 is shown by a curve 2129, the radiation efficiency of the third antenna 213 is shown by a curve 2139, and the radiation efficiency of the fourth antenna 214 is shown by a curve 2149. As shown in FIG. 2E, the radiation efficiency curves of the four-antenna array 21 in the first communication band 12 are all above 40%. FIG. 2F is a graph showing envelope correlation coefficient of the four-antenna array 21 of the multi-antenna communication device 2 in accordance with an embodiment of the disclosure. The envelope correlation coefficient between the first antenna 211 and the second antenna 212 is shown by a curve 14241, the envelope correlation coefficient between the first antenna 211 and the third antenna 213 is shown by a curve 14341, the envelope correlation coefficient between the first antenna 211 and the fourth antenna 214 is shown by a curve 14441, and the envelope correlation coefficient between the second antenna 212 and the third antenna 213 is shown by a curve 24341. As shown in FIG. 2F, the envelope correlation coefficient curves of the four-antenna array 11 in the first communication band 12 are all below 0.2.

The communication system operating band and experiment data described with respect to FIGS. 2C, 2D, 2E and 2F are merely to experimentally prove the technical effects of the multi-antenna communication device 2 according to the disclosure shown in FIGS. 2A and 2B, and do not intend to limit the communication operating bands, the applications and the specifications of the multi-antenna communication device of the disclosure in actual implementations. The multi-antenna communication device 2 according to the disclosure may be designed to cover system operating bands in WWAN (Wireless Wide Area Network), MIMO (Multi-input Multi-output) system, LTE (Long Term Evolution), pattern switchable antenna system, WLPN (Wireless Personal Network), WLAN (Wireless Local Area Network), beamforming antenna system, NFC (Near Field Communication), DTV (Digital Television Broadcasting System) or GPS (Global Positioning System). The four-antenna array 21 could be realized as a single set or multiple sets in the multi-antenna communication device 2 of the disclosure. The multi-antenna communication device 2 could be a mobile communication device, a wireless communication device, a mobile computing device, a computer system, a telecommunication apparatus, a network apparatus or a computer or network peripheral.

Figure 3A:
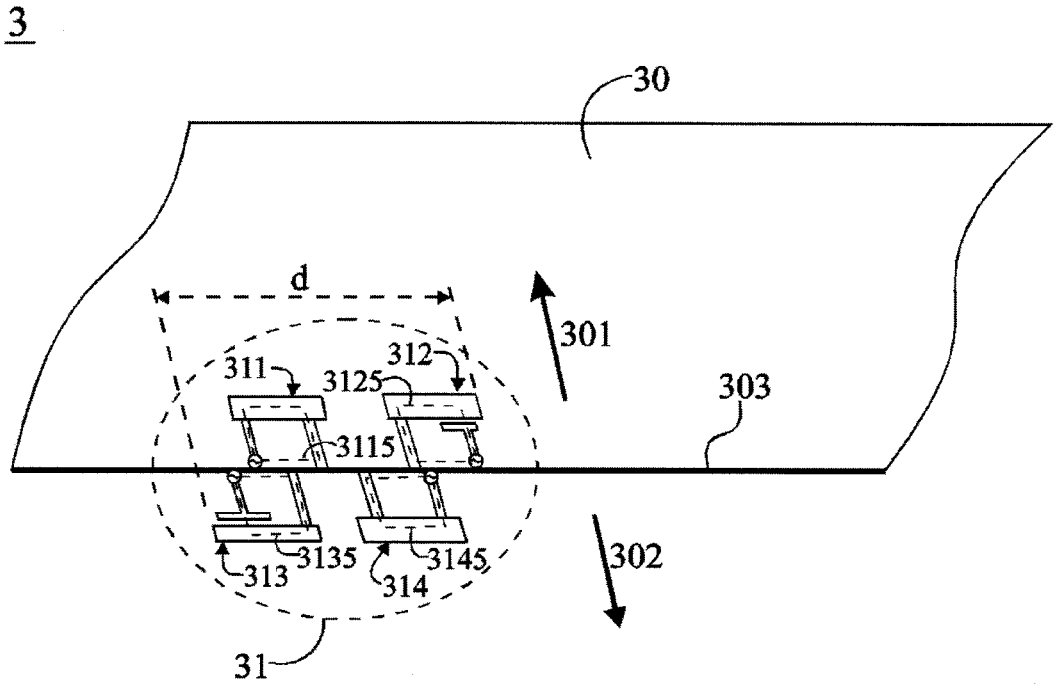
FIG. 3A is a structural diagram depicting a multi-antenna communication device 3 in accordance with an embodiment of the disclosure.
Figure 3B:
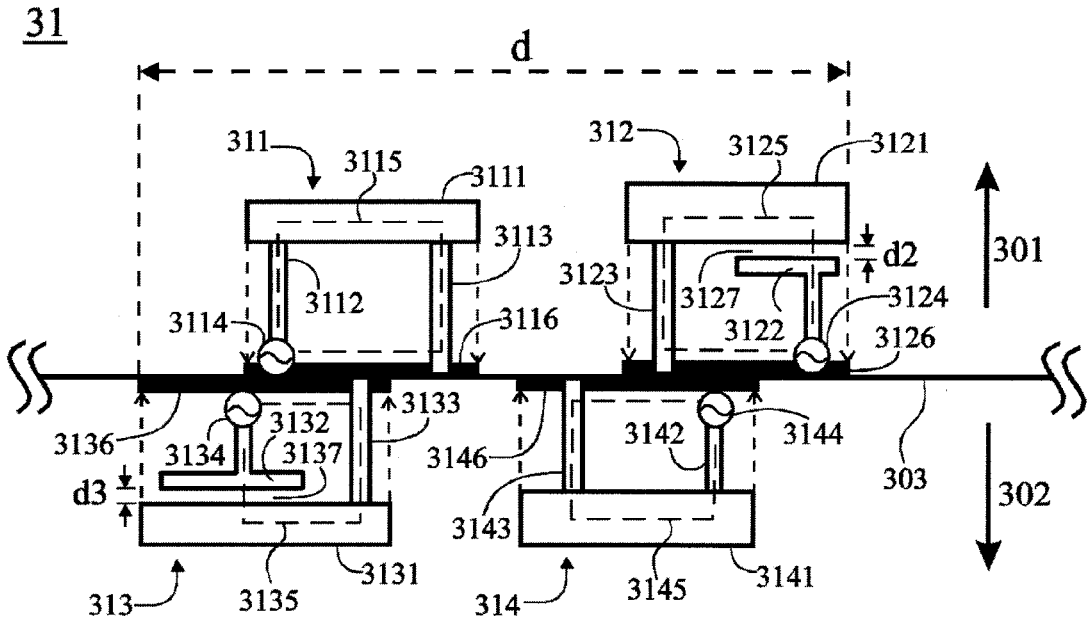
FIG. 3B is a structural diagram depicting a four-antenna array 31 of the multi-antenna communication device 3 in accordance with an embodiment of the disclosure.
Figure 3C:
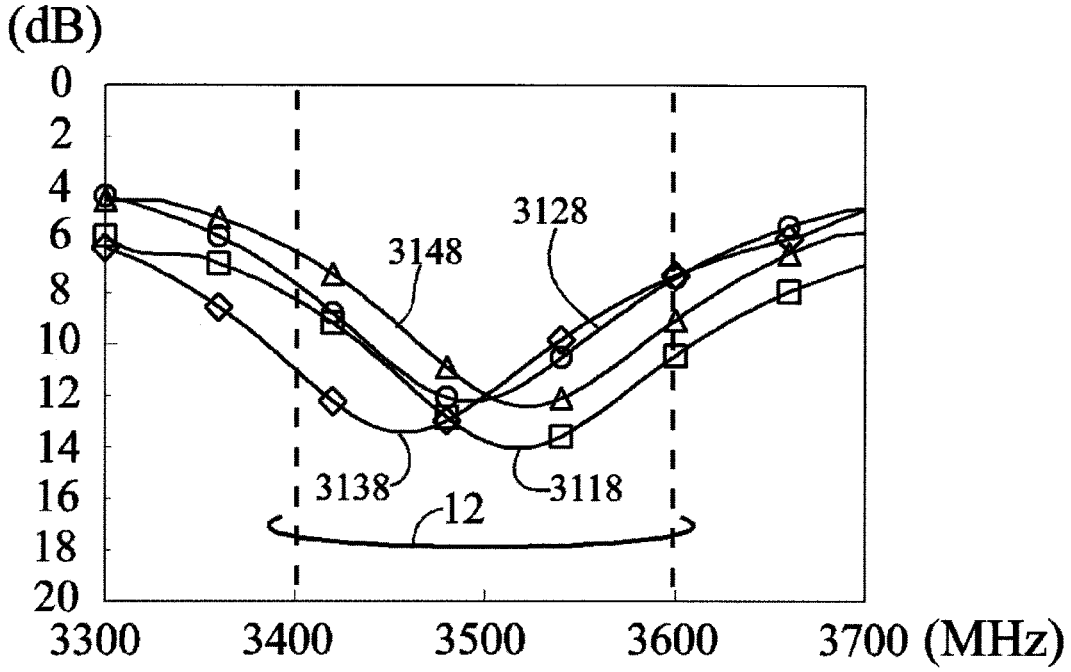
FIG. 3C is a graph showing return loss of the four-antenna array 31 of the multi-antenna communication device in accordance with an embodiment of the disclosure.

FIG. 3A is a structural diagram depicting a multi-antenna communication device 3 in accordance with an embodiment of the disclosure. FIG. 3B is a structural diagram depicting a four-antenna array 31 of the multi-antenna communication device 3 in accordance with an embodiment of the disclosure. FIG. 3C is a graph showing return loss of the four-antenna array 31 of the multi-antenna communication device 3 in accordance with an embodiment of the disclosure. As shown in FIG. 3A, the multi-antenna communication device 3 includes a grounding conductor plane 30 and a four-antenna array 31. The grounding conductor plane 30 separates a first side space 301 and a second side space 302 opposite to the first side space 301, and has a first edge 303. The four-antenna array 31 is located at the first edge 303, and has an overall maximum array length d extending along the first edge 303. As shown in FIGS. 3A and 3B, the four-antenna array 31 includes a first antenna 311, a second antenna 312, a third antenna 313 and a fourth antenna 314. As shown in FIG. 3B, the first antenna 311 is located in the first side space 301, and includes a first feeding conductor line 3112, a first grounding conductor line 3113, and a first radiating conductor portion 3111 electrically connected with a first signal source 3114 via the first feeding conductor line 3112 and electrically connected with the first edge 303 via the first grounding conductor line 3113, thereby forming a first loop path 3115 and generating at least one first resonant mode 3118 (as shown in FIG. 3C). The first radiating conductor portion 3111 has a first projection line segment 3116 at the first edge 303. The first loop path 3115 begins at the first signal source 3114, passes through the first feeding conductor line 3112, the first radiating conductor portion 3111, the first grounding conductor line 3113 and the first edge 303, and returns to the first signal source 3114. The second antenna 312 is located in the first side space 301, and includes a second feeding conductor line 3122, a second grounding conductor line 3123, and a second radiating conductor portion 3121 electrically connected with a second signal source 3124 via the second feeding conductor line 3122 and electrically connected with the first edge 303 via the second grounding conductor line 3123, thereby forming a second loop path 3125 and generating at least one second resonant mode 3128 (as shown in FIG. 3C). The second radiating conductor portion 3121 has a second projection line segment 3126 at the first edge 303. The second loop path 3125 begins at the second signal source 3124, passes through the second feeding conductor line 3122, the second radiating conductor portion 3121, the second grounding conductor line 3123 and the first edge 303, and returns to the second signal source 3124. The third antenna 313 is located in the second side space 302, and includes a third feeding conductor line 3132, a third grounding conductor line 3133, and a third radiating conductor portion 3131 electrically connected with a third signal source 3134 via the third feeding conductor line 3132 and electrically connected with the first edge 303 via the third grounding conductor line 3133, thereby forming a third loop path 3135 and generating at least one third resonant mode 3138 (as shown in FIG. 3C). The third radiating conductor portion 3131 has a third projection line segment 3136 at the first edge 303. The third loop path 3135 beings at the third signal source 3134, passes through the third feeding conductor line 3132, the third radiating conductor portion 3131, the third grounding conductor line 3133 and the first edge 303, and returns to the third signal source 3134. The fourth antenna 314 is located in the second side space 302, and includes a fourth feeding conductor line 3142, a fourth grounding conductor line 3143, and a fourth radiating conductor portion 3141 electrically connected with a fourth signal source 3144 via the fourth feeding conductor line 3142 and electrically connected with the first edge 303 via the fourth grounding conductor line 3143, thereby forming a fourth loop path 3145 and generating at least one fourth resonant mode 3148 (as shown in FIG. 3C). The fourth radiating conductor portion 3141 has a fourth projection line segment 3146 at the first edge 303. The fourth loop path 3145 begins at the fourth signal source 3144, passes through the fourth feeding conductor line 3142, the fourth radiating conductor portion 3141, the fourth grounding conductor line 3143 and the first edge 303, and returns to the fourth signal source 3144. The first projection line segment 3116 and the third projection line segment 3136 are partially but not completely overlapped. The second projection line segment 3126 and the fourth projection line segment 3146 are partially but not completely overlapped. The first, second, third, and fourth resonant modes 3118, 3128, 3138 and 3148 cover at least one identical first communication band 12 (as shown in FIG. 3C), and the overall maximum array length d of the four-antenna array 31 along the first edge 303 is between 0.25 wavelength and 0.49 wavelength of the lowest operating frequency of the first communication band 12. The lengths of the first loop path 3115, the second loop path 3125, the third loop path 3135 and the fourth loop path 3145 are all between 0.1 wavelength and 0.369 wavelength of the lowest operating frequency of the first communication band 12. The first feeding conductor line 3112 and the first grounding conductor line 3113 are electrically connected to the first radiating conductor portion 3111. The second feeding conductor line 3122 is spaced from the second radiating conductor portion 3121 at a second coupling gap 3127 that has an interval d2 less than or equal to 0.023 wavelength of the lowest operating frequency of the first communication band 12 (shown in FIG. 3C). The second grounding conductor line 3123 is electrically connected to the second radiating conductor portion 3121. With the second coupling gap 3127, a capacitive reactance could be created that effectively compensates the inductance of the second loop path 3125, thereby successfully reducing the required length of the second loop path 3125. The third feeding conductor line 3132 is spaced from the third radiating conductor portion 3131 at a third coupling gap 3137 that has an interval d3 less than or equal to 0.023 wavelength of the lowest operating frequency of the first communication band 12 (shown in FIG. 3C). The third grounding conductor line 3133 is electrically connected to the third radiating conductor portion 3131. With the third coupling gap 3137, a capacitive reactance could be created that effectively compensates the inductance of the third loop path 3135, thereby successfully reducing the required length of the third loop path 3135. The fourth feeding conductor line 3142 and the fourth grounding conductor line 3143 are electrically connected to the fourth radiating conductor portion 3141. The lengths of the first radiating conductor portion 3111, the second radiating conductor portion 3121, the third radiating conductor portion 3131 and the fourth radiating conductor portion 3141 are all between 0.05 wavelength and 0.233 wavelength of the lowest operating frequency of the first communication band 12 (as shown in FIG. 3C). The lengths of the first projection line segment 3116, the second projection line segment 3126, the third projection line segment 3136 and the fourth projection line segment 3146 are all between 0.01 wavelength and 0.22 wavelength of the lowest operating frequency of the first communication band 12 (as shown in FIG. 3C). Each of the first signal source 3114, the second signal source 3124, the third signal source 3134 and the fourth signal source 3144 could be a radio frequency circuit module, a radio frequency integrated circuit die, a radio frequency circuit switch, a radio frequency filter circuit, a radio frequency duplexer circuit, a radio frequency transmission line circuit, or a radio frequency capacitance, inductance or resistance matching circuit.

In the four-antenna array 31 of the multi-antenna communication device 3, although the first feeding conductor line 3112 is electrically connected with the first radiating conductor portion 3111, and the fourth feeding conductor line 3142 is electrically connected with the fourth radiating conductor portion 3141, which are slightly different from the multi-antenna communication device 1, when the first signal source 3114 and the fourth signal source 3144 are radio frequency capacitance matching circuits, capacitive reactance can also be generated, which effectively compensate the inductances of the first loop path 3115 and the fourth loop path 3145, thereby successfully reducing the required lengths of the first loop path 3115 and the fourth loop path 3145. Therefore, by providing four adjacent and downsized first loop path 3115, second loop path 3125, third loop path 3135 and fourth loop path 3145 at the first edge 303, the multi-antenna communication device 3 can effectively excite the grounding conductor plane 30 to create a more uniform strong current distribution, thus respectively producing the first resonant mode 3118, the second resonant mode 3128, the third resonant mode 3138 and the fourth resonant mode 3148 (shown in FIG. 3C). This also effectively reduces the variation of input impedance of the four-antenna array 31 with frequencies, and increases the respective operating bandwidths of the first resonant mode 3118, the second resonant mode 3128, the third resonant mode 3138 and the fourth resonant mode 3148. Moreover, as the four-antenna array 31 is configured with the first loop path 3115 and the second loop path 3125 in the first side space 301, and the third loop path 3135 and the fourth loop path 3145 in the second side space 302, the first loop path 3115 and the second loop path 3125 at the first side space 301 are able to effectively excite opposite current distributions along the first edge 303, and the third loop path 3135 and the fourth loop path 3145 in the second side space 302 are also able to effectively excite opposite current distributions along the first edge 303. As such, the envelope correlation coefficient between two adjacent downsized loop paths in the same side space could be effectively reduced, and the distance between the two adjacent downsized loop paths could be effectively reduced, resulting in a reduction in the maximum array length d of the four-antenna array 31 along the first edge 303. Furthermore, by allowing the first projection line segment 3116 and the third projection line segment 3136 to be partially but not completely overlapped, and the second projection line segment 3126 and the fourth projection line segment 3146 to be partially but not completely overlapped, the space wave energy coupling between adjacent downsized loop paths at the first side space 301 and the second side space 302 could be effectively reduced, resulting in a further reduction in the overall size of the four-antenna array 31 and an improvement in the antenna radiation characteristic. Thus, the multi-antenna communication device 3 achieves similar technical effect provided by the multi-antenna communication device 1.

FIG. 3C is a graph showing return loss of the four-antenna array 31 of the multi-antenna communication device 3 in accordance with an embodiment of the disclosure. The following dimensions are used in the experiments: the first edge 303 having a length of 180 mm; the first loop path 3115 having a length of about 26 mm, the second loop path 3125 having a length of about 27 mm, the third loop path 3135 having a length of about 25 mm, the fourth loop path 3145 having a length of about 26.5 mm; the maximum array length d of the four-antenna array 31 being about 36 mm; the second coupling gap 3127 having an interval d2 of about 0.5 mm, the third coupling gap 3137 having an interval d3 of about 0.3 mm; the first radiating conductor portion 3111 having a length of about 10 mm, the second radiating conductor portion 3121 having a length of about 10.5 mm, the third radiating conductor portion 3131 having a length of about 11 mm, the fourth radiating conductor portion 3141 having a length of about 10.5 mm; the maximum array length d of the four-antenna array 31 being about 36 mm; the first projection line segment 3116 having a length of about 10 mm, the second projection line segment 3126 having a length of about 10.5 mm, the third projection line segment 3136 having a length of about 11 mm, the fourth projection line segment 3146 having a length of about 10.5 mm. As shown in FIG. 3C, the first loop path 3115 generates at least one first resonant mode 3118, the second loop path 3125 generates at least one second resonant mode 3128, the third loop path 3135 generates at least one third resonant mode 3138, and the fourth loop path 3145 generates at least one fourth resonant mode 3148. In this embodiment, the first resonant mode 3118, the second resonant mode 3128, the third resonant mode 3138 and the fourth resonant mode 3148 cover the identical first communication band 12 (3400 MHz-3600 MHz). The lowest operating frequency of the first communication band 12 is about 3400 MHz.

Figure 3D:
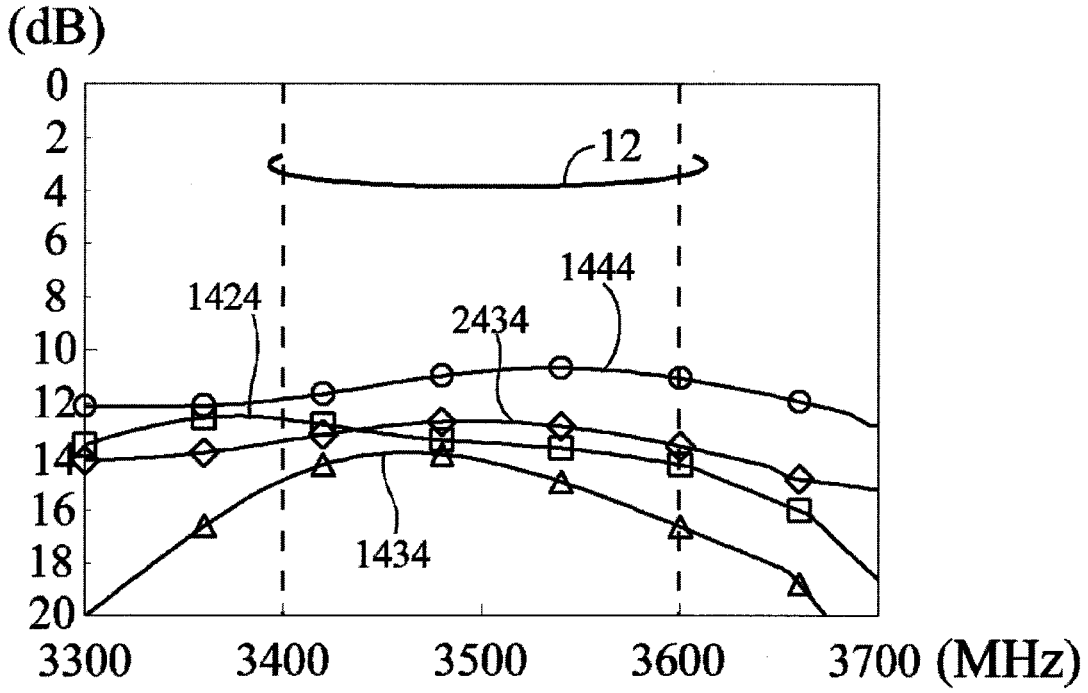
FIG. 3D is a graph showing isolation level of the four-antenna array 31 of the multi-antenna communication device 3 in accordance with an embodiment of the disclosure.
Figure 3E:
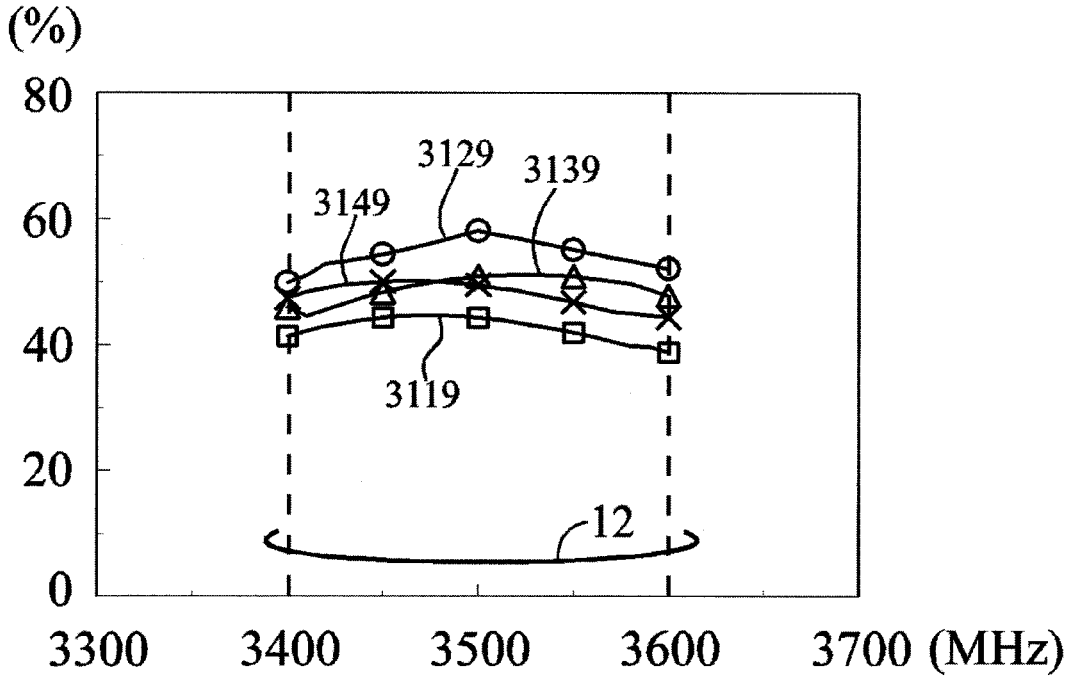
FIG. 3E is a graph showing radiation efficiency of the four-antenna array 31 of the multi-antenna communication device 3 in accordance with an embodiment of the disclosure.
Figure 3F:
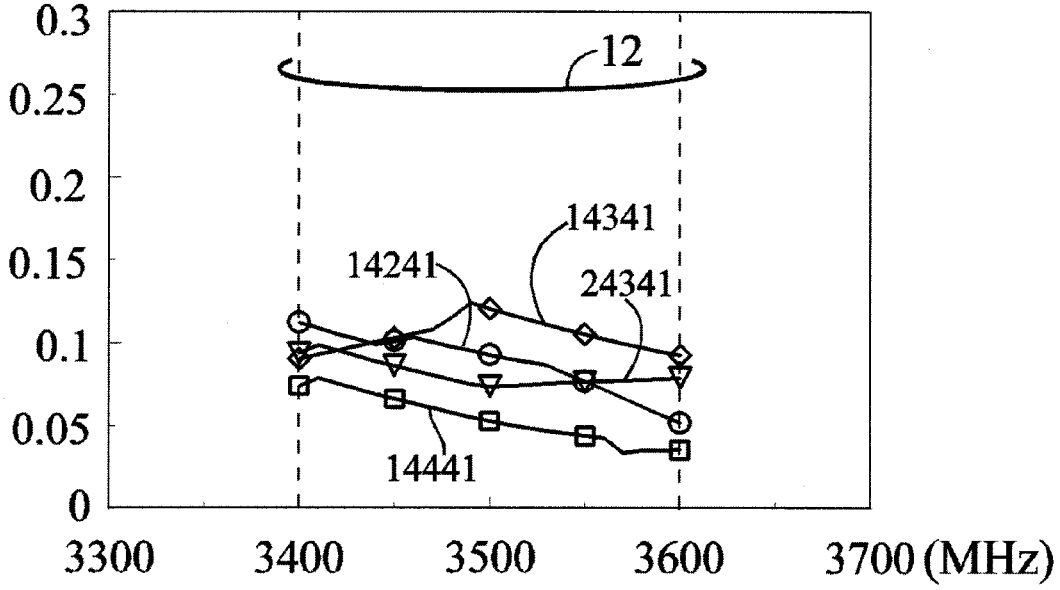
FIG. 3F is a graph showing envelope correlation coefficient of the four-antenna array 31 of the multi-antenna communication device 3 in accordance with an embodiment of the disclosure.

FIG. 3D is a graph showing the isolation level of the four-antenna array 31 of the multi-antenna communication device 3 in accordance with an embodiment of the disclosure. The isolation level between the first antenna 311 and the second antenna 312 is shown by a curve 1424, the isolation level between the first antenna 311 and the third antenna 313 is shown by a curve 1434, the isolation level between the first antenna 311 and the fourth antenna 314 is shown by a curve 1444, the isolation level between the second antenna 312 and the third antenna 313 is shown by a curve 2434. As shown in FIG. 3D, the curves of isolation level of the four-antenna array 31 in the first communication band 12 are all above 10 dB. FIG. 3E is a graph showing radiation efficiency of the four-antenna array 31 of the multi-antenna communication device 3 in accordance with an embodiment of the disclosure. The radiation efficiency of the first antenna 311 is shown by a curve 3119, the radiation efficiency of the second antenna 312 is shown by a curve 3129, the radiation efficiency of the third antenna 313 is shown by a curve 3139, and the radiation efficiency of the fourth antenna 314 is shown by a curve 3149. As shown in FIG. 3E, the radiation efficiency curves of the four-antenna array 31 in the first communication band 12 are all above 40%. FIG. 3F is a graph showing envelope correlation coefficient of the four-antenna array 31 of the multi-antenna communication device 3 in accordance with an embodiment of the disclosure. The envelope correlation coefficient between the first antenna 311 and the second antenna 312 is shown by a curve 14241, the envelope correlation coefficient between the first antenna 311 and the third antenna 313 is shown by a curve 14341, the envelope correlation coefficient between the first antenna 311 and the fourth antenna 314 is shown by a curve 14441, and the envelope correlation coefficient between the second antenna 312 and the third antenna 313 is shown by a curve 24341. As shown in FIG. 3F, the envelope correlation coefficient curves of the four-antenna array 31 in the first communication band 12 are all below 0.2.

The communication system operating band and experiment data described with respect to FIGS. 3C, 3D, 3E and 3F are merely to experimentally prove the technical effects of the multi-antenna communication device 3 according to the disclosure shown in FIGS. 3A and 3B, and do not intend to limit the communication operating bands, the applications and the specifications of the multi-antenna communication device of the disclosure in actual implementations. The multi-antenna communication device 3 according to the disclosure may be designed to cover system operating bands in WWAN (Wireless Wide Area Network), MIMO (Multi-input Multi-output) system, LTE (Long Term Evolution), pattern switchable antenna system, WLPN (Wireless Personal Network), WLAN (Wireless Local Area Network), beamforming antenna system, NFC (Near Field Communication), DTV (Digital Television Broadcasting System) or GPS (Global Positioning System). The four-antenna array 31 could be realized as a single set or multiple sets in the multi-antenna communication device 3 according to the disclosure. The multi-antenna communication device 3 could be a mobile communication device, a wireless communication device, a mobile computing device, a computer system, a telecommunication apparatus, a network apparatus or a computer or network peripheral.

Figure 4A:
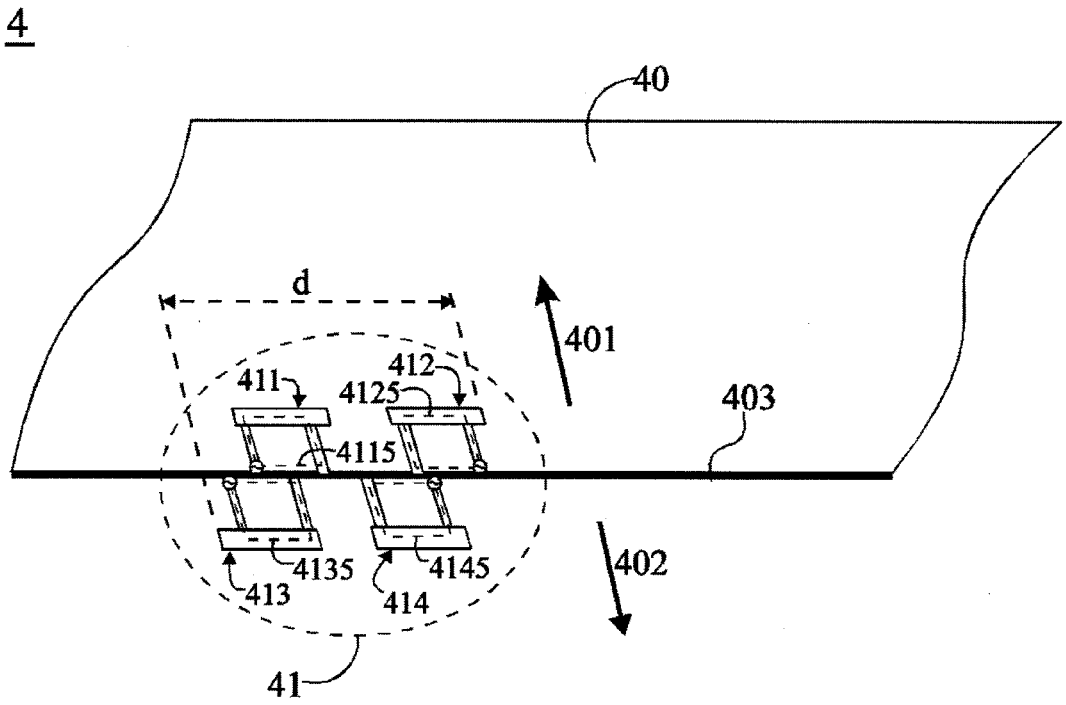
FIG. 4A is a structural diagram depicting a multi-antenna communication device 4 in accordance with an embodiment of the disclosure.
Figure 4B:
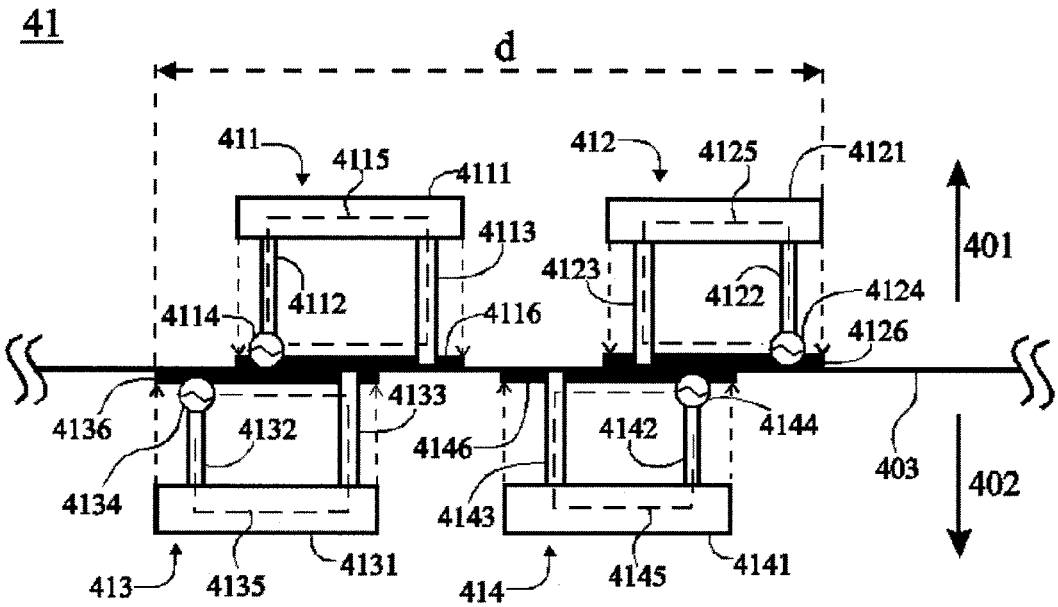
FIG. 4B is a structural diagram depicting a four-antenna array 41 of the multi-antenna communication device 4 in accordance with an embodiment of the disclosure.
Figure 4C:
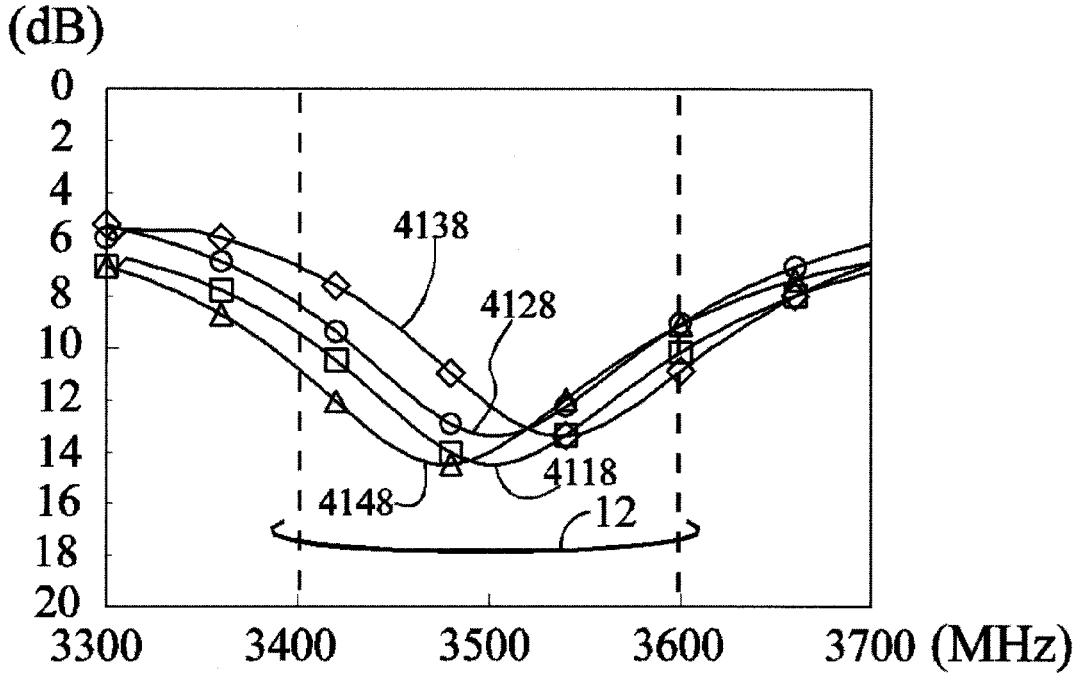
FIG. 4C is a graph showing return loss of the four-antenna array 41 of the multi-antenna communication device 4 in accordance with an embodiment of the disclosure.

FIG. 4A is a structural diagram depicting a multi-antenna communication device 4 in accordance with an embodiment of the disclosure. FIG. 4B is a structural diagram depicting a four-antenna array 41 of the multi-antenna communication device 4 in accordance with an embodiment of the disclosure. FIG. 4C is a graph showing return loss of the four-antenna array 41 of the multi-antenna communication device 4 in accordance with an embodiment of the disclosure. As shown in FIG. 4A, the multi-antenna communication device 4 includes a grounding conductor plane 40 and a four-antenna array 41. The grounding conductor plane 40 separates a first side space 401 and a second side space 402 opposite to the first side space 401, and has a first edge 403. The four-antenna array 41 is located at the first edge 403, and has an overall maximum array length d extending along the first edge 403. As shown in FIGS. 4A and 4B, the four-antenna array 41 includes a first antenna 411, a second antenna 412, a third antenna 413 and a fourth antenna 414. As shown in FIG. 4B, the first antenna 411 is located in the first side space 401, and includes a first feeding conductor line 4112, a first grounding conductor line 4113, and a first radiating conductor portion 4111 electrically connected with a first signal source 4114 via the first feeding conductor line 4112 and electrically connected with the first edge 403 via the first grounding conductor line 4113, thereby forming a first loop path 4115 and generating at least one first resonant mode 4118 (as shown in FIG. 4C). The first radiating conductor portion 4111 has a first projection line segment 4116 at the first edge 403. The first loop path 4115 begins at the first signal source 4114, passes through the first feeding conductor line 4112, the first radiating conductor portion 4111, the first grounding conductor line 4113 and the first edge 403, and returns to the first signal source 4114. The second antenna 412 is located in the first side space 401, and includes a second feeding conductor line 4122, a second grounding conductor line 4123, and a second radiating conductor portion 4121 electrically connected with a second signal source 4124 via the second feeding conductor line 4122 and electrically connected with the first edge 403 via the second grounding conductor line 4123, thereby forming a second loop path 4125 and generating at least one second resonant mode 4128 (as shown in FIG. 4C). The second radiating conductor portion 4121 has a second projection line segment 4126 at the first edge 403. The second loop path 4125 begins at the second signal source 4124, passes through the second feeding conductor line 4122, the second radiating conductor portion 4121, the second grounding conductor line 4123 and the first edge 403, and returns to the second signal source 4124. The third antenna 413 is located in the second side space 402, and includes a third feeding conductor line 4132, a third grounding conductor line 4133, and a third radiating conductor portion 4131 electrically connected with a third signal source 4134 via the third feeding conductor line 4132 and electrically connected with the first edge 403 via the third grounding conductor line 4133, thereby forming a third loop path 4135 and generating at least one third resonant mode 4138 (as shown in FIG. 4C). The third radiating conductor portion 4131 has a third projection line segment 4136 at the first edge 403. The third loop path 4135 begins at the third signal source 4134, passes through the third feeding conductor line 4132, the third radiating conductor portion 4131, the third grounding conductor line 4133 and the first edge 403, and returns to the third signal source 4134. The fourth antenna 414 is located in the second side space 402, and includes a fourth feeding conductor line 4142, a fourth grounding conductor line 4143, and a fourth radiating conductor portion 4141 electrically connected with a fourth signal source 4144 via the fourth feeding conductor line 4142 and electrically connected with the first edge 403 via the fourth grounding conductor line 4143, thereby forming a fourth loop path 4145 and generating at least one fourth resonant mode 4148 (as shown in FIG. 4C). The fourth radiating conductor portion 4141 has a fourth projection line segment 4146 at the first edge 403. The fourth loop path 4145 begins at the fourth signal source 4144, passes through the fourth feeding conductor line 4142, the fourth radiating conductor portion 4141, the fourth grounding conductor line 4143 and the first edge 403, and returns to the fourth signal source 4144. The first projection line segment 4116 and the third projection line segment 4136 are partially but not completely overlapped. The second projection line segment 4126 and the fourth projection line segment 4146 are partially but not completely overlapped. The first, second, third, and fourth resonant modes 4118, 4128, 4138 and 4148 cover at least one identical first communication band 12 (as shown in FIG. 4C), and the overall maximum array length d of the four-antenna array 41 along the first edge 403 is between 0.25 wavelength and 0.49 wavelength of the lowest operating frequency of the first communication band 12. The lengths of the first loop path 4115, the second loop path 4125, the third loop path 4135 and the fourth loop path 4145 are all between 0.1 wavelength and 0.369 wavelength of the lowest operating frequency of the first communication band 12. The first feeding conductor line 4112 and the first grounding conductor line 4113 are electrically connected to the first radiating conductor portion 4111. The second feeding conductor line 4122 and the second grounding conductor line 4123 are electrically connected to the second radiating conductor portion 4121. The third feeding conductor line 4132 and the third grounding conductor line 4133 are electrically connected to the third radiating conductor portion 4131. The fourth feeding conductor line 4142 and the fourth grounding conductor line 4143 are electrically connected to the fourth radiating conductor portion 4141. The lengths of the first radiating conductor portion 4111, the second radiating conductor portion 4121, the third radiating conductor portion 4131 and the fourth radiating conductor portion 4141 are all between 0.05 wavelength and 0.233 wavelength of the lowest operating frequency of the first communication band 12 (as shown in FIG. 4C). The lengths of the first projection line segment 4116, the second projection line segment 4126, the third projection line segment 4136 and the fourth projection line segment 4146 are all between 0.01 wavelength and 0.22 wavelength of the lowest operating frequency of the first communication band 12 (as shown in FIG. 4C). Each of the first signal source 4114, the second signal source 4124, the third signal source 4134 and the fourth signal source 4144 could be a radio frequency circuit module, a radio frequency integrated circuit die, a radio frequency circuit switch, a radio frequency filter circuit, a radio frequency duplexer circuit, a radio frequency transmission line circuit, or a radio frequency capacitance, inductance or resistance matching circuit.

In the four-antenna array 41 of the multi-antenna communication device 4, although the second feeding conductor line 4112 is electrically connected with the second radiating conductor portion 4121, and the third feeding conductor line 4132 is electrically connected with the third radiating conductor portion 4131, which are slightly different from the multi-antenna communication device 3, when the second signal source 4124 and the third signal source 4134 are radio frequency capacitance matching circuits, capacitive reactance can also be generated, which effectively compensate the inductances of the second loop path 4125 and the third loop path 4135, thereby successfully reducing the lengths of the second loop path 4125 and the third loop path 4135. Therefore, by providing four adjacent and downsized first loop path 4115, second loop path 4125, third loop path 4135 and fourth loop path 4145 at the first edge 403, the multi-antenna communication device 4 can effectively excite the grounding conductor plane 40 to create a more uniform strong current distribution, thus respectively producing the first resonant mode 4118, the second resonant mode 4128, the third resonant mode 4138 and the fourth resonant mode 4148 (shown in FIG. 4C). This also effectively reduces the variation of input impedance of the four-antenna array 41 with the frequency, and increases the respective operating bandwidths of the first resonant mode 4118, the second resonant mode 4128, the third resonant mode 4138 and the fourth resonant mode 4148. Moreover, as the four-antenna array 41 is configured with the first loop path 4115 and the second loop path 4125 in the first side space 401, and the third loop path 4135 and the fourth loop path 4145 in the second side space 402, the first loop path 4115 and the second loop path 4125 in the first side space 401 are able to effectively excite opposite current distributions along the first edge 403, and the third loop path 4135 and the fourth loop path 4145 in the second side space 402 are also able to effectively excite opposite current distributions along the first edge 403. As such, the envelope correlation coefficient between two adjacent downsized loop paths in the same side space may be effectively reduced, and the distance between the two adjacent downsized loop paths may be effectively reduced, resulting in a reduction in the maximum array length d of the four-antenna array 41 along the first edge 403. Furthermore, by allowing the first projection line segment 4116 and the third projection line segment 4136 to be partially but not completely overlapped, and the second projection line segment 4126 and the fourth projection line segment 4146 to be partially but not completely overlapped, the space wave energy coupling between adjacent downsized loop paths in the first side space 401 and the second side space 402 may be effectively reduced, resulting in a further reduction in the overall size of the four-antenna array 41 and an improvement in the antenna radiation characteristic. Thus, the multi-antenna communication device 4 can achieve similar technical effect provided by the multi-antenna communication device 3.

FIG. 4C is a graph showing return loss of the four-antenna array 41 of the multi-antenna communication device 4 in accordance with an embodiment of the disclosure. The following dimensions are used in the experiments: the first edge 403 having a length of 160 mm; the first loop path 4115 having a length of about 26 mm, the second loop path 4125 having a length of about 27 mm, the third loop path 4135 having a length of about 25 mm, the fourth loop path 4145 having a length of about 26.5 mm; the maximum array length d of the four-antenna array 41 being about 36 mm; the first radiating conductor portion 4111 having a length of about 10 mm, the second radiating conductor portion 4121 having a length of about 10.5 mm, the third radiating conductor portion 4131 having a length of about 11 mm, the fourth radiating conductor portion 4141 having a length of about 10.5 mm; the maximum array length d of the four-antenna array 41 being about 36 mm; the first projection line segment 4116 having a length of about 10 mm, the second projection line segment 4126 having a length of about 10.5 mm, the third projection line segment 4136 having a length of about 11 mm, the fourth projection line segment 4146 having a length of about 10.5 mm. As shown in FIG. 4C, the first loop path 4115 generates at least one first resonant mode 4118, the second loop path 4125 generates at least one second resonant mode 4128, the third loop path 4135 generates at least one third resonant mode 4138, and the fourth loop path 4145 generates at least one fourth resonant mode 4148. In this embodiment, the first resonant mode 4118, the second resonant mode 4128, the third resonant mode 4138 and the fourth resonant mode 4148 cover the identical first communication band 12 (3400 MHz-3600 MHz). The lowest operating frequency of the first communication band 12 is about 3400 MHz.

Figure 4D:
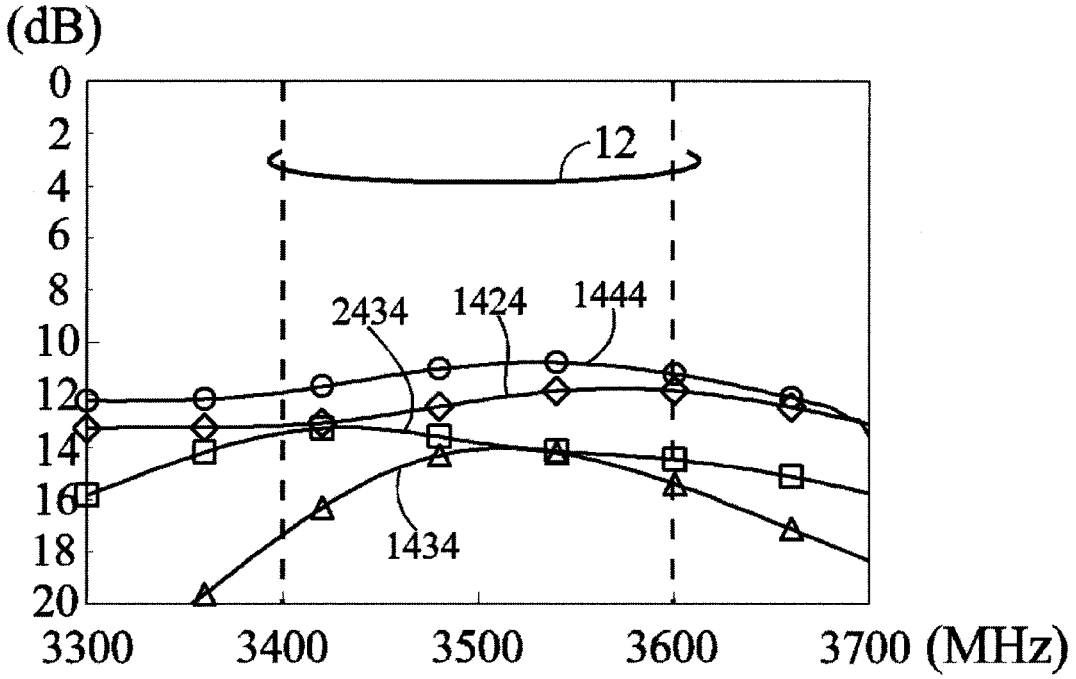
FIG. 4D is a graph showing isolation level of the four-antenna array 41 of the multi-antenna communication device 4 in accordance with an embodiment of the disclosure.
Figure 4E:
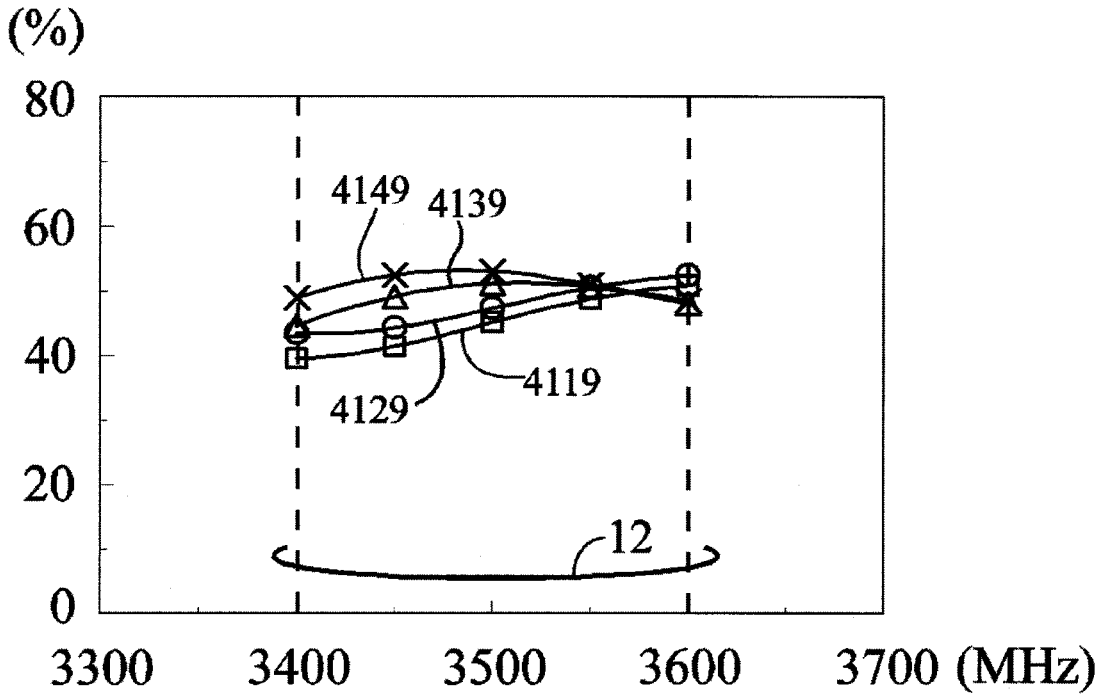
FIG. 4E is a graph showing radiation efficiency of the four-antenna array 41 of the multi-antenna communication device 4 in accordance with an embodiment of the disclosure.
Figure 4F:
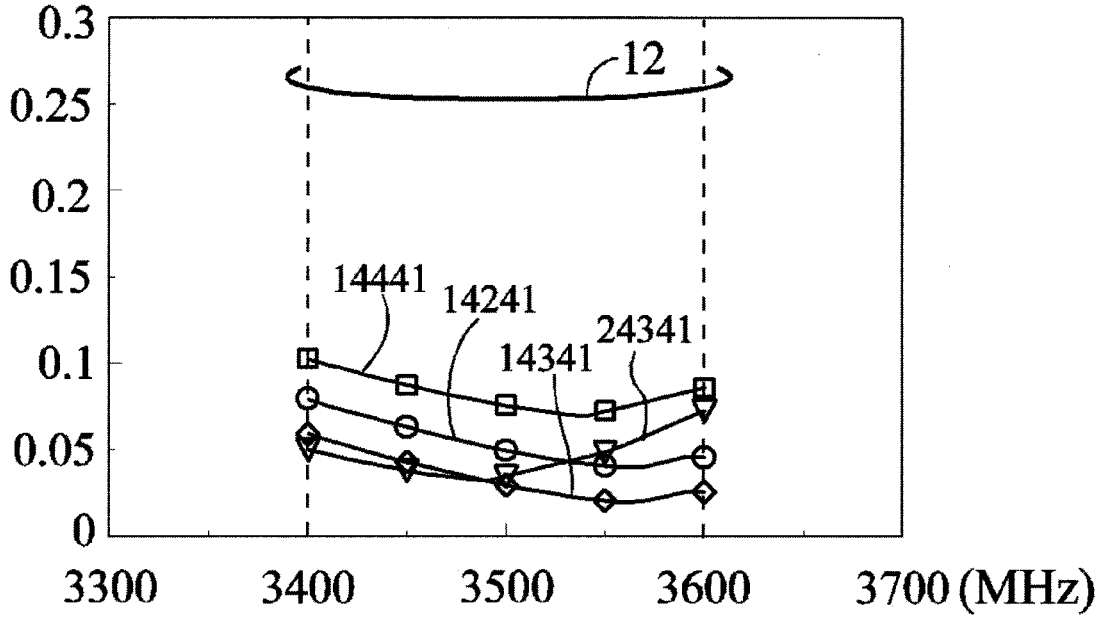
FIG. 4F is a graph showing envelope correlation coefficient of the four-antenna array 41 of the multi-antenna communication device 4 in accordance with an embodiment of the disclosure.

FIG. 4D is a graph showing the isolation level of the four-antenna array 41 of the multi-antenna communication device 4 in accordance with an embodiment of the disclosure. The isolation level between the first antenna 411 and the second antenna 412 is shown by a curve 1424, the isolation level between the first antenna 411 and the third antenna 413 is shown by a curve 1434, the isolation level between the first antenna 411 and the fourth antenna 414 is shown by a curve 1444, the isolation level between the second antenna 412 and the third antenna 413 is shown by a curve 2434. As shown in FIG. 4D, the curves of isolation level of the four-antenna array 41 in the first communication band 12 are all above 10 dB. FIG. 4E is a graph showing radiation efficiency of the four-antenna array 41 of the multi-antenna communication device 4 in accordance with an embodiment of the disclosure. The radiation efficiency of the first antenna 411 is shown by a curve 4119, the radiation efficiency of the second antenna 412 is shown by a curve 4129, the radiation efficiency of the third antenna 413 is shown by a curve 4139, and the radiation efficiency of the fourth antenna 414 is shown by a curve 4149. As shown in FIG. 4E, the radiation efficiency curves of the four-antenna array 41 in the first communication band 12 are all above 40%. FIG. 4F is a graph showing envelope correlation coefficient of the four-antenna array 41 of the multi-antenna communication device 4 in accordance with an embodiment of the disclosure. The envelope correlation coefficient between the first antenna 411 and the second antenna 412 is shown by a curve 14241, the envelope correlation coefficient between the first antenna 411 and the third antenna 413 is shown by a curve 14341, the envelope correlation coefficient between the first antenna 411 and the fourth antenna 414 is shown by a curve 14441, and the envelope correlation coefficient between the second antenna 412 and the third antenna 413 is shown by a curve 24341. As shown in FIG. 4F, the envelope correlation coefficient curves of the four-antenna array 41 in the first communication band 12 are all below 0.2.

The communication system operating band and experiment data described with respect to FIGS. 4C, 4D, 4E and 4F are merely to experimentally prove the technical effects of the multi-antenna communication device 4 according to the disclosure shown in FIGS. 4A and 4B, and do not intend to limit the communication operating bands, the applications and the specifications of the multi-antenna communication device of the disclosure in actual implementations. The multi-antenna communication device 4 according to the disclosure could be designed to cover system operating bands in WWAN (Wireless Wide Area Network), MIMO (Multi-input Multi-output) system, LTE (Long Term Evolution), pattern switchable antenna system, WLPN (Wireless Personal Network), WLAN (Wireless Local Area Network), beamforming antenna system, NFC (Near Field Communication), DTV (Digital Television Broadcasting System) or GPS (Global Positioning System). The four-antenna array 41 could be realized as a single set or multiple sets in the multi-antenna communication device 4 according to the disclosure. The multi-antenna communication device 4 could be a mobile communication device, a wireless communication device, a mobile computing device, a computer system, a telecommunication apparatus, a network apparatus or a computer or network peripheral.

Figure 5A:
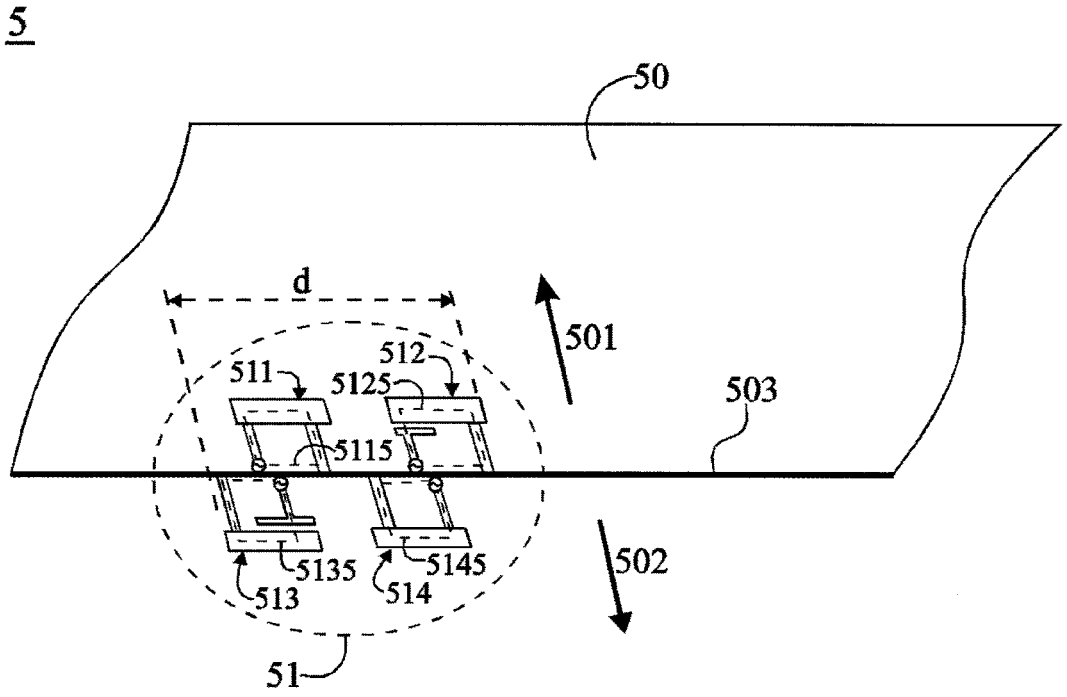
FIG. 5A is a structural diagram depicting a multi-antenna communication device 5 in accordance with an embodiment of the disclosure.
Figure 5B:
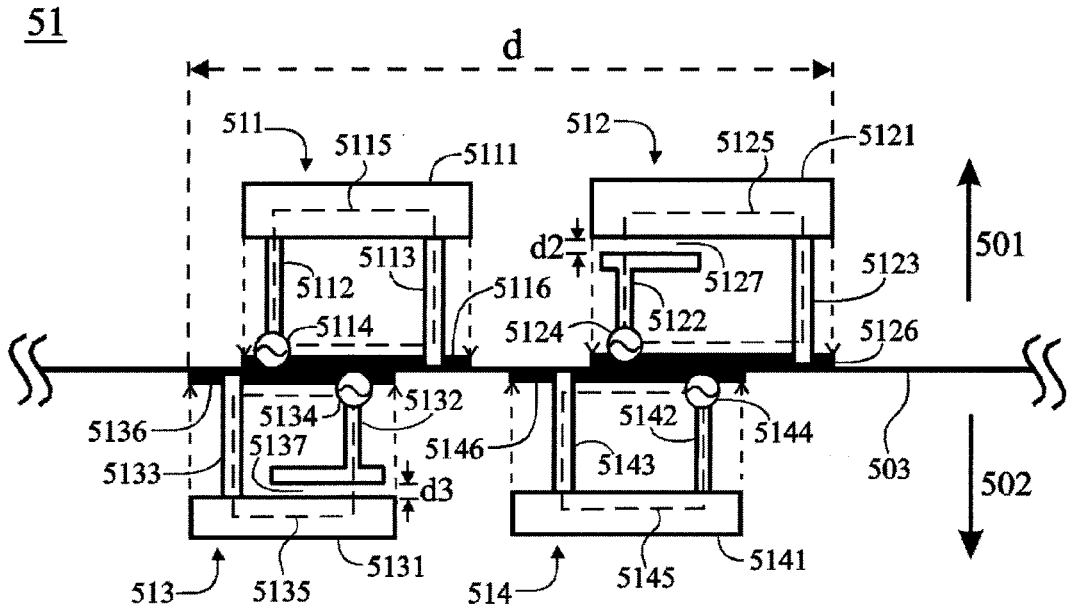
FIG. 5B is a structural diagram depicting a four-antenna array 51 of the multi-antenna communication device 5 in accordance with an embodiment of the disclosure.

FIG. 5A is a structural diagram depicting a multi-antenna communication device 5 in accordance with an embodiment of the disclosure. FIG. 5B is a structural diagram depicting a four-antenna array 51 of the multi-antenna communication device 5 in accordance with an embodiment of the disclosure. As shown in FIG. 5A, the multi-antenna communication device 5 includes a grounding conductor plane 50 and a four-antenna array 51. The grounding conductor plane 50 separates a first side space 501 and a second side space 502 opposite to the first side space 501, and has a first edge 503. The four-antenna array 51 is located at the first edge 503, and has an overall maximum array length d extending along the first edge 503. As shown in FIGS. 5A and 5B, the four-antenna array 51 includes a first antenna 511, a second antenna 512, a third antenna 513 and a fourth antenna 514. As shown in FIG. 5B, the first antenna 511 is located in the first side space 501, and includes a first feeding conductor line 5112, a first grounding conductor line 5113, and a first radiating conductor portion 5111 electrically connected with a first signal source 5114 via the first feeding conductor line 5112 and electrically connected with the first edge 503 via the first grounding conductor line 5113, thereby forming a first loop path 5115 and generating at least one first resonant mode. The first radiating conductor portion 5111 has a first projection line segment 5116 at the first edge 503. The first loop path 5115 begins at the first signal source 5114, passes through the first feeding conductor line 5112, the first radiating conductor portion 5111, the first grounding conductor line 5113 and the first edge 503, and returns to the first signal source 5114. The second antenna 512 is located in the first side space 501, and includes a second feeding conductor line 5122, a second grounding conductor line 5123, and a second radiating conductor portion 5121 electrically connected with a second signal source 5124 via the second feeding conductor line 5122 and electrically connected with the first edge 503 via the second grounding conductor line 5123, thereby forming a second loop path 5125 and generating at least one second resonant mode. The second radiating conductor portion 5121 has a second projection line segment 5126 at the first edge 503. The second loop path 5125 begins at the second signal source 5124, passes through the second feeding conductor line 5122, the second radiating conductor portion 5121, the second grounding conductor line 5123 and the first edge 503, and returns to the second signal source 5124. The third antenna 513 is located in the second side space 502, and includes a third feeding conductor line 5132, a third grounding conductor line 5133, and a third radiating conductor portion 5131 electrically connected with a third signal source 5134 via the third feeding conductor line 5132 and electrically connected with the first edge 503 via the third grounding conductor line 5133, thereby forming a third loop path 5135 and generating at least one third resonant mode. The third radiating conductor portion 5131 has a third projection line segment 5136 at the first edge 503. The third loop path 5135 begins at the third signal source 5134, passes through the third feeding conductor line 5132, the third radiating conductor portion 5131, the third grounding conductor line 5133 and the first edge 503, and returns to the third signal source 5134. The fourth antenna 514 is located in the second side space 502, and includes a fourth feeding conductor line 5142, a fourth grounding conductor line 5143, and a fourth radiating conductor portion 5141 electrically connected with a fourth signal source 5144 via the fourth feeding conductor line 5142 and electrically connected with the first edge 503 via the fourth grounding conductor line 5143, thereby forming a fourth loop path 5145 and generating at least one fourth resonant mode. The fourth radiating conductor portion 5141 has a fourth projection line segment 5146 at the first edge 503. The fourth loop path 5145 begins at the fourth signal source 5144, passes through the fourth feeding conductor line 5142, the fourth radiating conductor portion 5141, the fourth grounding conductor line 5143 and the first edge 503, and returns to the fourth signal source 5144. The first projection line segment 5116 and the third projection line segment 5136 are partially but not completely overlapped. The second projection line segment 5126 and the fourth projection line segment 5146 are partially but not completely overlapped. The first, second, third, and fourth resonant modes cover at least one identical first communication band, and the overall maximum array length d of the four-antenna array 51 along the first edge 503 is between 0.25 wavelength and 0.49 wavelength of the lowest operating frequency of the first communication band. The lengths of the first loop path 5115, the second loop path 5125, the third loop path 5135 and the fourth loop path 5145 are all between 0.1 wavelength and 0.369 wavelength of the lowest operating frequency of the first communication band. The first feeding conductor line 5112 and the first grounding conductor line 5113 are electrically connected to the first radiating conductor portion 5111. The second feeding conductor line 5122 is spaced from the second radiating conductor portion 5121 at a second coupling gap 5127 that has an interval d2 less than or equal to 0.023 wavelength of the lowest operating frequency of the first communication band. The second grounding conductor line 5123 is electrically connected to the second radiating conductor portion 5121. With the second coupling gap 5127, a capacitive reactance could be created that effectively compensates the inductance of the second loop path 5125, thereby successfully reducing the length of the second loop path 5125. The third feeding conductor line 5132 is spaced from the third radiating conductor portion 5131 at a third coupling gap 5137 that has an interval d3 less than or equal to 0.023 wavelength of the lowest operating frequency of the first communication band. The third grounding conductor line 5133 is electrically connected to the third radiating conductor portion 5131. With the third coupling gap 5137, a capacitive reactance could be created that effectively compensates the inductance of the third loop path 5135, thereby successfully reducing the length of the third loop path 5135. The fourth feeding conductor line 5142 and the fourth grounding conductor line 5143 are electrically connected to the fourth radiating conductor portion 5141. The lengths of the first radiating conductor portion 5111, the second radiating conductor portion 5121, the third radiating conductor portion 5131 and the fourth radiating conductor portion 5141 are all between 0.05 wavelength and 0.233 wavelength of the lowest operating frequency of the first communication band. The lengths of the first projection line segment 5116, the second projection line segment 5126, the third projection line segment 5136 and the fourth projection line segment 5146 are all between 0.01 wavelength and 0.22 wavelength of the lowest operating frequency of the first communication band. Each of the first signal source 5114, the second signal source 5124, the third signal source 5134 and the fourth signal source 5144 could be a radio frequency circuit module, a radio frequency integrated circuit die, a radio frequency circuit switch, a radio frequency filter circuit, a radio frequency duplexer circuit, a radio frequency transmission line circuit, or a radio frequency capacitance, inductance or resistance matching circuit.

In the four-antenna array 51 of the multi-antenna communication device 5, although the first feeding conductor line 5112 is electrically connected with the first radiating conductor portion 5111, and the fourth feeding conductor line 5142 is electrically connected with the fourth radiating conductor portion 5141, which are slightly different from multi-antenna communication device 1, when the first signal source 5114 and the fourth signal source 5144 are radio frequency capacitance matching circuits, capacitive reactance can also be generated, which effectively compensate the inductances of the first loop path 5115 and the fourth loop path 5145, thereby successfully reducing the lengths of the first loop path 5115 and the fourth loop path 5145. Therefore, by providing four adjacent and downsized first loop path 5115, second loop path 5125, third loop path 5135 and fourth loop path 5145 at the first edge 503, the multi-antenna communication device 5 can effectively excite the grounding conductor plane 50 to create a more uniform strong current distribution, thus respectively producing the first resonant mode, the second resonant mode, the third resonant mode and the fourth resonant mode. This also effectively reduces the variation of input impedance of the four-antenna array 51 with frequencies, and increases the respective operating bandwidths of the first resonant mode, the second resonant mode, the third resonant mode and the fourth resonant mode. Moreover, as the four-antenna array 51 is configured with the first loop path 5115 and the second loop path 5125 at the first side space 501, and the third loop path 5135 and the fourth loop path 5145 in the second side space 502, the first loop path 5115 and the second loop path 5125 in the first side space 501 are able to effectively excite opposite current distributions along the first edge 503, and the third loop path 5135 and the fourth loop path 5145 in the second side space 502 are also able to effectively excite opposite current distributions along the first edge 503. As such, the envelope correlation coefficient between two adjacent downsized loop paths at the same side space could be effectively reduced, and the distance between the two adjacent downsized loop paths could be effectively reduced, resulting in a reduction in the maximum array length d of the four-antenna array 51 along the first edge 503. Furthermore, by allowing the first projection line segment 5116 and the third projection line segment 5136 to be partially but not completely overlapped, and the second projection line segment 5126 and the fourth projection line segment 5146 to be partially but not completely overlapped, the space wave energy coupling between adjacent downsized loop paths in the first side space 501 and the second side space 502 could be effectively reduced, resulting in a further reduction in the overall size of the four-antenna array 51 and an improvement in the antenna radiation characteristic. Thus, the multi-antenna communication device 5 can achieve similar technical performance provided by the multi-antenna communication device 1.

The multi-antenna communication device 5 according to the disclosure may be designed to cover system operating bands in WWAN (Wireless Wide Area Network), MIMO (Multi-input Multi-output) system, LTE (Long Term Evolution), pattern switchable antenna system, WLPN (Wireless Personal Network), WLAN (Wireless Local Area Network), beamforming antenna system, NFC (Near Field Communication), DTV (Digital Television Broadcasting System) or GPS (Global Positioning System). The four-antenna array 51 could be realized as a single set or multiple sets in the multi-antenna communication device 5 according to the disclosure. The multi-antenna communication device 5 could be a mobile communication device, a wireless communication device, a mobile computing device, a computer system, a telecommunication apparatus, a network apparatus or a computer or network peripheral.

FIG. 6A is a structural diagram depicting a multi-antenna communication device 6 in accordance with an embodiment of the disclosure. FIG. 6B is a structural diagram depicting a four-antenna array 61 of the multi-antenna communication device 6 in accordance with an embodiment of the disclosure. As shown in FIG. 6A, the multi-antenna communication device 6 includes a grounding conductor plane 60 and a four-antenna array 61. The grounding conductor plane 60 separates a first side space 601 and a second side space 602 opposite to the first side space 601, and has a first edge 603. The four-antenna array 61 is located at the first edge 603, and has an overall maximum array length d extending along the first edge 603. As shown in FIGS. 6A and 6B, the four-antenna array 61 includes a first antenna 611, a second antenna 612, a third antenna 613 and a fourth antenna 614. As shown in FIG. 6B, the first antenna 611 is located in the first side space 601, and includes a first feeding conductor line 6112, a first grounding conductor line 6113, and a first radiating conductor portion 6111 electrically connected with a first signal source 6114 via the first feeding conductor line 6112 and electrically connected with the first edge 603 via the first grounding conductor line 6113, thereby forming a first loop path 6115 and generating at least one first resonant mode. The first radiating conductor portion 6111 has a first projection line segment 6116 at the first edge 603. The first loop path 6115 begins at the first signal source 6114, passes through the first feeding conductor line 6112, the first radiating conductor portion 6111, the first grounding conductor line 6113 and the first edge 603, and returns to the first signal source 6114. The second antenna 612 is located in the first side space 601, and includes a second feeding conductor line 6122, a second grounding conductor line 6123, and a second radiating conductor portion 6121 electrically connected with a second signal source 6124 via the second feeding conductor line 6122 and electrically connected with the first edge 603 via the second grounding conductor line 6123, thereby forming a second loop path 6125 and generating at least one second resonant mode. The second radiating conductor portion 6121 has a second projection line segment 6126 at the first edge 603. The second loop path 6125 begins at the second signal source 6124, passes through the second feeding conductor line 6122, the second radiating conductor portion 6121, the second grounding conductor line 6123 and the first edge 603, and returns to the second signal source 6124. The third antenna 613 is located in the second side space 602, and includes a third feeding conductor line 6132, a third grounding conductor line 6133, and a third radiating conductor portion 6131 electrically connected with a third signal source 6134 via the third feeding conductor line 6132 and electrically connected with the first edge 603 via the third grounding conductor line 6133, thereby forming a third loop path 6135 and generating at least one third resonant mode. The third radiating conductor portion 6131 has a third projection line segment 6136 at the first edge 603. The third loop path 6135 begins at the third signal source 6134, passes through the third feeding conductor line 6132, the third radiating conductor portion 6131, the third grounding conductor line 6133 and the first edge 603, and returns to the third signal source 6134. The fourth antenna 614 is located in the second side space 602, and includes a fourth feeding conductor line 6142, a fourth grounding conductor line 6143, and a fourth radiating conductor portion 6141 electrically connected with a fourth signal source 6144 via the fourth feeding conductor line 6142 and electrically connected with the first edge 603 via the fourth grounding conductor line 6143, thereby forming a fourth loop path 6145 and generating at least one fourth resonant mode. The fourth radiating conductor portion 6141 has a fourth projection line segment 6146 at the first edge 603. The fourth loop path 6145 begins at the fourth signal source 6144, passes through the fourth feeding conductor line 6142, the fourth radiating conductor portion 6141, the fourth grounding conductor line 6143 and the first edge 603, and returns to the fourth signal source 6144. The first projection line segment 6116 and the third projection line segment 6136 are partially but not completely overlapped. The second projection line segment 6126 and the fourth projection line segment 6146 are partially but not completely overlapped. The first, second, third, and fourth resonant modes cover at least one identical first communication band, and the overall maximum array length d of the four-antenna array 61 along the first edge 603 is between 0.25 wavelength and 0.49 wavelength of the lowest operating frequency of the first communication band. The lengths of the first loop path 6115, the second loop path 6125, the third loop path 6135 and the fourth loop path 6145 are all between 0.1 wavelength and 0.369 wavelength of the lowest operating frequency of the first communication band. The first grounding conductor line 6113 is spaced from the first radiating conductor portion 6111 at a first coupling gap 6117 that has an interval d1 less than or equal to 0.023 wavelength of the lowest operating frequency of the first communication band. The first feeding conductor line 6112 is electrically connected to the first radiating conductor portion 6111. With the first coupling gap 6117, a capacitive reactance could be created that effectively compensates the inductance of the first loop path 6115, thereby successfully reducing the length of the first loop path 6115. The second feeding conductor line 6122 is spaced from the second radiating conductor portion 6121 at a second coupling gap 6127 that has an interval d2 less than or equal to 0.023 wavelength of the lowest operating frequency of the first communication band. The second grounding conductor line 6123 is electrically connected to the second radiating conductor portion 6121. With the second coupling gap 6127, a capacitive reactance could be created that effectively compensates the inductance of the second loop path 6125, thereby successfully reducing the length of the second loop path 6125. The third feeding conductor line 6132 is spaced from the third radiating conductor portion 6131 at a third coupling gap 6137 that has an interval d3 less than or equal to 0.023 wavelength of the lowest operating frequency of the first communication band. The third grounding conductor line 6133 is electrically connected to the third radiating conductor portion 6131. With the third coupling gap 6137, a capacitive reactance could be created that effectively compensates the inductance of the third loop path 6135, thereby successfully reducing the length of the third loop path 6135. The fourth grounding conductor line 6143 is spaced from the fourth radiating conductor portion 6141 at a fourth coupling gap 6147 that has an interval d4 less than or equal to 0.023 wavelength of the lowest operating frequency of the first communication band. The fourth feeding conductor line 6142 is electrically connected to the fourth radiating conductor portion 6141. With the fourth coupling gap 6147, a capacitive reactance could be created that effectively compensates the inductance of the fourth loop path 6145, thereby successfully reducing the length of the fourth loop path 6145. The lengths of the first radiating conductor portion 6111, the second radiating conductor portion 6121, the third radiating conductor portion 6131 and the fourth radiating conductor portion 6141 are all between 0.05 wavelength and 0.233 wavelength of the lowest operating frequency of the first communication band. The lengths of the first projection line segment 6116, the second projection line segment 6126, the third projection line segment 6136 and the fourth projection line segment 6146 are all between 0.01 wavelength and 0.22 wavelength of the lowest operating frequency of the first communication band. Each of the first signal source 6114, the second signal source 6124, the third signal source 6134 and the fourth signal source 6144 could be a radio frequency circuit module, a radio frequency integrated circuit die, a radio frequency circuit switch, a radio frequency filter circuit, a radio frequency duplexer circuit, a radio frequency transmission line circuit, or a radio frequency capacitance, inductance or resistance matching circuit.

In the four-antenna array 61 of the multi-antenna communication device 6, although the first feeding conductor line 6112 is electrically connected with the first radiating conductor portion 6111, and the fourth feeding conductor line 6142 is electrically connected with the fourth radiating conductor portion 6141, which are slightly different from multi-antenna communication device 1, the first coupling gap 6117 and the fourth coupling gap 6147 can similarly generate capacitive reactance, which effectively compensate the inductances of the first loop path 6115 and the fourth loop path 6145, thereby successfully reducing the lengths of the first loop path 6115 and the fourth loop path 6145. Therefore, by providing four adjacent and downsized first loop path 6115, second loop path 6125, third loop path 6135 and fourth loop path 6145 at the first edge 603, the multi-antenna communication device 6 can effectively excite the grounding conductor plane 60 to create a more uniform strong current distribution, thus respectively producing the first resonant mode, the second resonant mode, the third resonant mode and the fourth resonant mode. This also effectively reduces the variation of input impedance of the four-antenna array 61 with frequencies, and increases the respective operating bandwidths of the first resonant mode, the second resonant mode, the third resonant mode and the fourth resonant mode. Moreover, as the four-antenna array 61 is configured with the first loop path 6115 and the second loop path 6125 in the first side space 601, and the third loop path 6135 and the fourth loop path 6145 at the second side space 602, the first loop path 6115 and the second loop path 6125 in the first side space 601 are able to effectively excite opposite current distributions along the first edge 603, and the third loop path 6135 and the fourth loop path 6145 in the second side space 602 are also able to effectively excite opposite current distributions along the first edge 603. As such, the envelope correlation coefficient between two adjacent downsized loop paths in the same side space may be effectively reduced, and the distance between the two adjacent downsized loop paths may be effectively reduced, resulting in a reduction in the maximum array length d of the four-antenna array 61 along the first edge 603. Furthermore, by allowing the first projection line segment 6116 and the third projection line segment 6136 to be partially but not completely overlapped, and the second projection line segment 6126 and the fourth projection line segment 6146 to be partially but not completely overlapped, the space wave energy coupling between adjacent downsized loop paths in the first side space 601 and the second side space 602 could be effectively reduced, resulting in a further reduction in the overall size of the four-antenna array 61 and an improvement in the antenna radiation characteristic. Thus, the multi-antenna communication device 6 can achieve similar technical effect provided by the multi-antenna communication device 1.

The multi-antenna communication device 6 according to the disclosure may be designed to cover system operating bands in WWAN (Wireless Wide Area Network), MIMO (Multi-input Multi-output) system, LTE (Long Term Evolution), pattern switchable antenna system, WLPN (Wireless Personal Network), WLAN (Wireless Local Area Network), beamforming antenna system, NFC (Near Field Communication), DTV (Digital Television Broadcasting System) or GPS (Global Positioning System). The four-antenna array 61 could be realized as a single set or multiple sets in the multi-antenna communication device 6 according to the disclosure. The multi-antenna communication device 6 could be a mobile communication device, a wireless communication device, a mobile computing device, a computer system, a telecommunication apparatus, a network apparatus or a computer or network peripheral.

The disclosure provides an integrated multi-antenna communication device with low correlation coefficient, which effectively reduces the overall size of the four-antenna array applied in the communication device and satisfies the need for high speed data transmission in future multi-antenna communication devices.

The above embodiments are only used to illustrate the principles of the disclosure, and should not be construed as to limit the disclosure in any way. The above embodiments may be modified by those with ordinary skill in the art without departing from the scope of the disclosure as defined in the following appended claims.

What is claimed is:

1. A multi-antenna communication device, comprising:

a grounding conductor plane separating along a normal direction thereof a first side space and a second side space opposite to the first side space and including a first edge; and a four-antenna array located at the first edge and having an overall maximum array length extending along the first edge, the four-antenna array including:

a first antenna located in the first side space including a first feeding conductor line, a first grounding conductor line, and a first radiating conductor portion electrically connected with a first signal source via the first feeding conductor line and electrically connected with the first edge via the first grounding conductor line, forming a first loop path and generating at least one first resonant mode, the first radiating conductor portion having a first projection line segment at the first edge;

a second antenna located in the first side space including a second feeding conductor line, a second grounding conductor line, and a second radiating conductor portion electrically connected with a second signal source via the second feeding conductor line and electrically connected with the first edge via the second grounding conductor line, forming a second loop path and generating at least one second resonant mode, the second radiating conductor portion having a second projection line segment at the first edge;

a third antenna located in the second side space including a third feeding conductor line, a third grounding conductor line, and a third radiating conductor portion electrically connected with a third signal source via the third feeding conductor line and electrically connected with the first edge via the third grounding conductor line, forming a third loop path and generating at least one third resonant mode, the third radiating conductor portion having a third projection line segment at the first edge; and a fourth antenna located in the second side space including a fourth feeding conductor line, a fourth grounding conductor line, and a fourth radiating conductor portion electrically connected with a fourth signal source via the fourth feeding conductor line and electrically connected with the first edge via the fourth grounding conductor line, forming a fourth loop path and generating at least one fourth resonant mode, the fourth radiating conductor portion having a fourth projection line segment on the first edge, wherein the first projection line segment and the third projection line segment are partially overlapped, the second projection line segment and the fourth projection line segment are partially overlapped, the first, second, third, and fourth resonant modes cover at least one identical first communication band, and the overall maximum array length of the four-antenna array along the first edge is between 0.25 wavelength and 0.49 wavelength of a lowest operating frequency of the first communication band.

2. The multi-antenna communication device of claim 1, wherein lengths of the first loop path, the second loop path, the third loop path and the fourth loop path are all between 0.1 wavelength and 0.369 wavelength of the lowest operating frequency of the first communication band.

3. The multi-antenna communication device of claim 2, wherein the first loop path begins at the first signal source, passes through the first feeding conductor line, the first radiating conductor portion, the first grounding conductor line and the first edge, and returns to the first signal source.

4. The multi-antenna communication device of claim 2, wherein the second loop path begins at the second signal source, passes through the second feeding conductor line, the second radiating conductor portion, the second grounding conductor line and the first edge, and returns to the second signal source.

5. The multi-antenna communication device of claim 2, wherein the third loop path begins at the third signal source, passes through the third feeding conductor line, the third radiating conductor portion, the third grounding conductor line and the first edge, and returns to the third signal source.

6. The multi-antenna communication device of claim 2, wherein the fourth loop path begins at the fourth signal source, passes through the fourth feeding conductor line, the fourth radiating conductor portion, the fourth grounding conductor line and the first edge, and returns to the fourth signal source.

7. The multi-antenna communication device of claim 1, wherein the first projection line segment and the third projection line segment are partially but not completely overlapped, and the second projection line segment and the fourth projection line segment are partially but not completely overlapped.

8. The multi-antenna communication device of claim 1, wherein the first feeding conductor line or the first grounding conductor line is spaced from the first radiating conductor portion at a first coupling gap that has a first interval less than or equal to 0.023 wavelength of the lowest operating frequency of the first communication band.

9. The multi-antenna communication device of claim 1, wherein the second feeding conductor line or the second grounding conductor line is spaced from the second radiating conductor portion at a second coupling gap that has a second interval less than or equal to 0.023 wavelength of the lowest operating frequency of the first communication band.

10. The multi-antenna communication device of claim 1, wherein the third feeding conductor line or the third grounding conductor line is spaced from the third radiating conductor portion at a third coupling gap that has a third interval less than or equal to 0.023 wavelength of the lowest operating frequency of the first communication band.

11. The multi-antenna communication device of claim 1, wherein the fourth feeding conductor line or the fourth grounding conductor line is spaced from the fourth radiating conductor portion at a fourth coupling gap that has a fourth interval less than or equal to 0.023 wavelength of the lowest operating frequency of the first communication band.

12. The multi-antenna communication device of claim 1, wherein the first feeding conductor line and the first grounding conductor line are electrically connected with the first radiating conductor portion.

13. The multi-antenna communication device of claim 1, wherein the second feeding conductor line and the second grounding conductor line are electrically connected with the second radiating conductor portion.

14. The multi-antenna communication device of claim 1, wherein the third feeding conductor line and the third grounding conductor line are electrically connected with the third radiating conductor portion.

15. The multi-antenna communication device of claim 1, wherein the fourth feeding conductor line and the fourth grounding conductor line are electrically connected with the fourth radiating conductor portion.

16. The multi-antenna communication device of claim 1, wherein lengths of the first radiating conductor portion, the second radiating conductor portion, the third radiating conductor portion and the fourth radiating conductor portion are all between 0.05 wavelength and 0.233 wavelength of the lowest operating frequency of the first communication band.

17. The multi-antenna communication device of claim 1, wherein lengths of the first projection line segment, the second projection line segment, the third projection line segment and the fourth projection line segment are all between 0.01 wavelength and 0.22 wavelength of the lowest operating frequency of the first communication band.

18. The multi-antenna communication device of claim 1, wherein the four-antenna array is realized as a single set or multiple sets in the multi-antenna communication device, and the multi-antenna communication device is a mobile communication device, a wireless communication device, a mobile computing device, a computer system, a telecommunication apparatus, a network apparatus or a computer or network peripheral.

19. The multi-antenna communication device of claim 1, wherein each of the first signal source, the second signal source, the third signal source and the fourth signal source is a radio frequency circuit module, a radio frequency integrated circuit die, a radio frequency circuit switch, a radio frequency filter circuit, a radio frequency duplexer circuit, a radio frequency transmission line circuit, or a radio frequency capacitance, inductance or resistance matching circuit.

* * * * *